US010072405B2

(12) United States Patent
Beck et al.

(10) Patent No.: US 10,072,405 B2
(45) Date of Patent: Sep. 11, 2018

(54) DRAIN CLEANING APPARATUS

(71) Applicant: PF Waterworks LP, Houston, TX (US)

(72) Inventors: Harold Kent Beck, Copper Canyon, TX (US); Sanjay Ahuja, Katy, TX (US); Stephen Samuel Hodgson, Houston, TX (US)

(73) Assignee: PF Waterworks LP, Houston, TX (US)

( * ) Notice: Subject to any disclaimer, the term of this patent is extended or adjusted under 35 U.S.C. 154(b) by 316 days.

(21) Appl. No.: 15/009,613

(22) Filed: Jan. 28, 2016

(65) Prior Publication Data

US 2016/0221050 A1 Aug. 4, 2016

Related U.S. Application Data

(60) Provisional application No. 62/109,743, filed on Jan. 30, 2015.

(51) Int. Cl.
*E03C 1/302* (2006.01)
*B08B 9/04* (2006.01)
(Continued)

(52) U.S. Cl.
CPC ..... *E03C 1/302* (2013.01); *B08B 9/027* (2013.01); *B08B 9/04* (2013.01); *B25G 1/04* (2013.01); *B25G 1/102* (2013.01)

(58) Field of Classification Search
CPC . E03C 1/30; E03C 1/302; E03F 9/002; B08B 9/027; B08B 9/04
USPC ... 15/104.05, 104.16, 104.2, 104.31–104.33; 4/255.01; 294/65.5, 190; 362/109, 119, 362/120, 253
See application file for complete search history.

(56) References Cited

U.S. PATENT DOCUMENTS 566,110 A * 8/1896 Wrigley ..... E03F 9/005 15/104.33
584,508 A * 6/1897 Hughes ..... E03F 9/00 15/104.31
(Continued)

FOREIGN PATENT DOCUMENTS

EP 2363213 * 1/2011
FR 3009007 * 1/2016
(Continued)

OTHER PUBLICATIONS

Partial machine translation of DE 2363213, Sep. 7, 2011.*

*Primary Examiner* — Mark Spisich
(74) *Attorney, Agent, or Firm* — Stephen S. Hodgson

(57) ABSTRACT

A drain cleaning apparatus, includes a handle and a clog-catching member detachably connected the handle. Airplane-like wings project radially from the clog-catching member. The wings provide an angled projection that catches and holds a clump of debris in a drain pipe for unclogging the drain. Clog-catching members or smooth extension members can be connected end to end for different lengths. Different end tools can be removably connected to a clog-catching member or to a smooth extension member to provide multifunctionality. A drain cleaning harpoon that is an integral unit or one that can be assembled and disassembled is also provided. The harpoon can be fitted on one end with a plurality of J hooks, fish hooks, arrowheads or retractable barbs for catching and holding a mass of debris in a drain pipe.

29 Claims, 9 Drawing Sheets

(51) Int. Cl.

| | |
|---|---|
| ***B08B 9/027*** | (2006.01) |
| ***B25G 1/10*** | (2006.01) |
| ***B25G 1/04*** | (2006.01) |

(56) References Cited

U.S. PATENT DOCUMENTS

| | | | | | |
|---|---|---|---|---|---|
| 834,135 | A | * | 10/1906 | Hymes | E03C 1/302 15/104.33 |
| 874,957 | A | | 12/1907 | Godley | |
| 1,261,444 | A | * | 4/1918 | Schied | E03C 1/302 15/104.001 |
| 1,262,755 | A | | 4/1918 | Cutler | |
| 1,600,373 | A | * | 9/1926 | Stremel | E03C 1/302 15/104.33 |
| 1,653,995 | A | * | 12/1927 | English | B25G 1/02 15/104.33 |
| 1,758,504 | A | * | 5/1930 | English | B25B 27/0028 15/104.32 |
| 2,284,939 | A | | 6/1942 | Asnard | |
| 2,568,347 | A | * | 9/1951 | Lundelius | B08B 9/0433 134/167 C |
| 2,797,423 | A | | 7/1957 | Rizor | |
| 2,993,723 | A | * | 7/1961 | Twachtman | B03C 1/28 294/65.5 |
| 3,449,003 | A | | 6/1969 | Hunt | |
| 4,012,155 | A | | 3/1977 | Morris | |
| 4,042,305 | A | | 8/1977 | Vincent | |
| 4,232,419 | A | | 11/1980 | Sanger | |
| 4,508,468 | A | | 4/1985 | Irwin | |
| 4,771,500 | A | | 9/1988 | Kovacs | |
| 5,276,934 | A | | 1/1994 | Brzoska | |
| 5,379,496 | A | | 1/1995 | Krauss | |
| 5,507,076 | A | | 4/1996 | Anscher | |
| 5,769,960 | A | | 6/1998 | Nirmel | |
| 5,820,249 | A | * | 10/1998 | Walsten | H02G 1/081 362/119 |
| 5,836,032 | A | | 11/1998 | Hondo | |
| 6,094,765 | A | | 8/2000 | Askenase | |
| 6,131,229 | A | | 10/2000 | Lincuna et al. | |
| 6,688,800 | B2 | | 2/2004 | Kresge | |
| 6,775,873 | B2 | | 8/2004 | Luoma | |
| 6,789,933 | B2 | | 9/2004 | Gili et al. | |
| D511,278 | S | | 11/2005 | Carfagnini | |
| 7,356,869 | B2 | | 4/2008 | Knopow et al. | |
| 7,404,686 | B2 | | 7/2008 | Volum | |
| 7,584,513 | B2 | | 9/2009 | Turner | |
| 7,610,635 | B2 | | 11/2009 | Schultz et al. | |
| 8,033,678 | B2 | * | 10/2011 | Patterson | H02G 1/081 254/134.3 FT |
| 8,359,696 | B1 | | 1/2013 | Turner et al. | |
| 8,365,337 | B2 | | 2/2013 | Tash | |
| 9,194,114 | B2 | | 11/2015 | Petry | |
| 9,217,243 | B2 | | 12/2015 | Gwen | |
| 2004/0163166 | A1 | * | 8/2004 | Alldredge | A47K 11/10 4/255.01 |
| 2009/0293214 | A1 | * | 12/2009 | Ackerman | B08B 9/0436 15/104.05 |
| 2010/0132101 | A1 | * | 6/2010 | Bates | E03C 1/304 4/255.04 |
| 2010/0132143 | A1 | * | 6/2010 | Flamand | B08B 9/045 15/104.33 |
| 2013/0000680 | A1 | * | 1/2013 | Azelton | B08B 9/0436 134/22.11 |
| 2015/0176263 | A1 | * | 6/2015 | Lei | E03C 1/302 4/255.01 |
| 2016/0067752 | A1 | * | 3/2016 | Dennis | B08B 9/0436 4/255.01 |
| 2016/0194857 | A1 | * | 7/2016 | Chen | E03C 1/302 15/22.1 |

FOREIGN PATENT DOCUMENTS

| | | | |
|---|---|---|---|
| GB | 23604 | * | 10/1914 |
| GB | 358883 | A | 7/1930 |

* cited by examiner

FIG.10
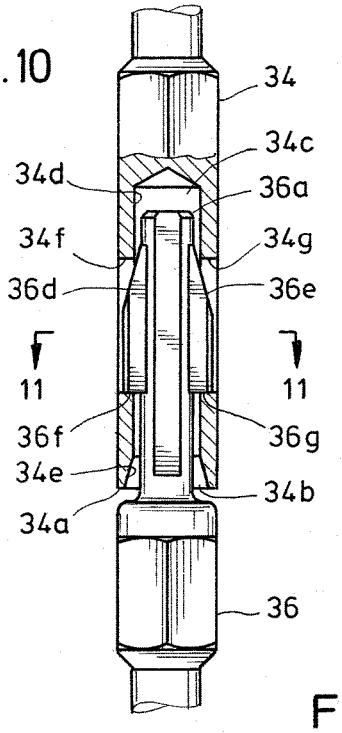
FIG.11
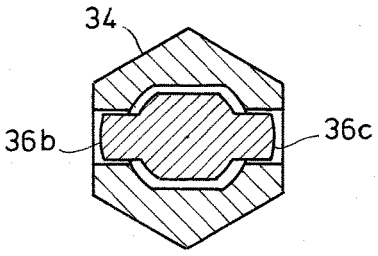
FIG.15
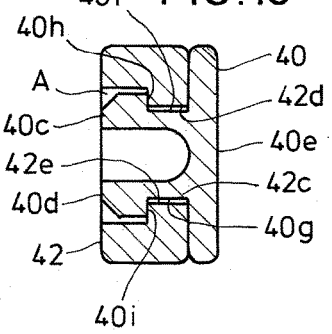
FIG.13
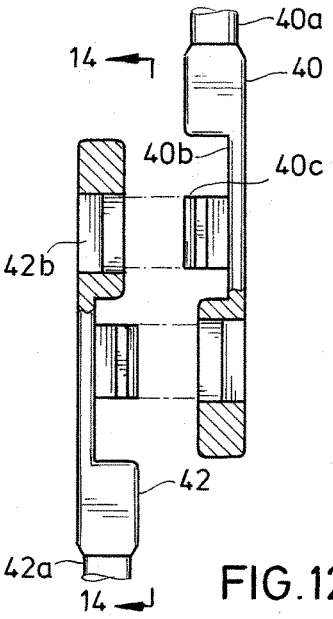
FIG.12
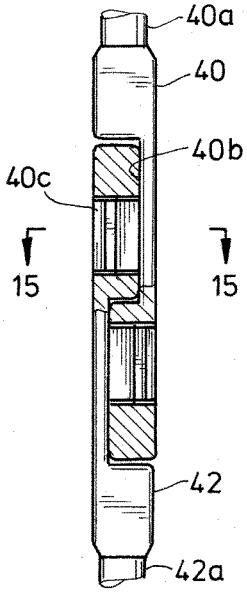
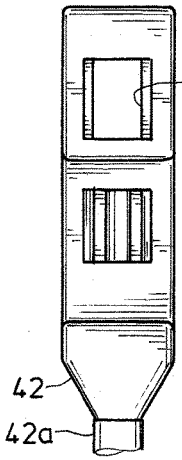
FIG.14

64
68d
68b
68a
68
66c
68c
68e
66a
66
72a
72b
66b
72c
70a
70

52c
52
52b
52a
50
54a
54
54b
56a
56
56d
56b 56
56b
56c
56d
50

60
60b
60a
58b
58
58a
58c 74d
74
74c
74b
74a 76d
76
76c
76b
76a 78d
78b
78a
78
78c
78e
78e

FIG. 24
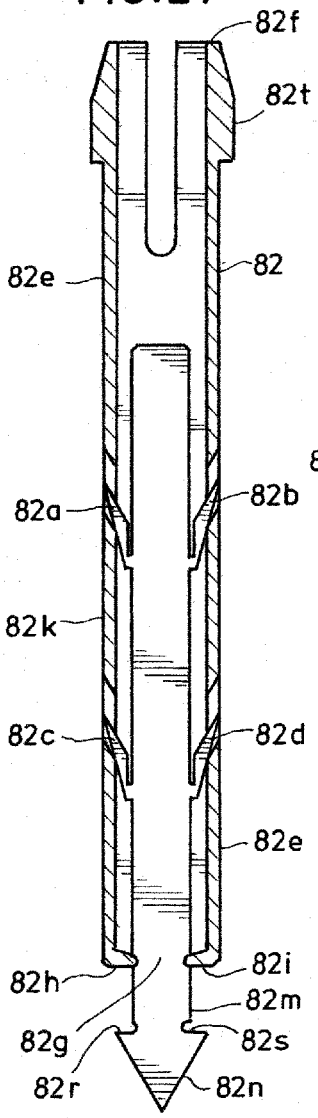
FIG. 25
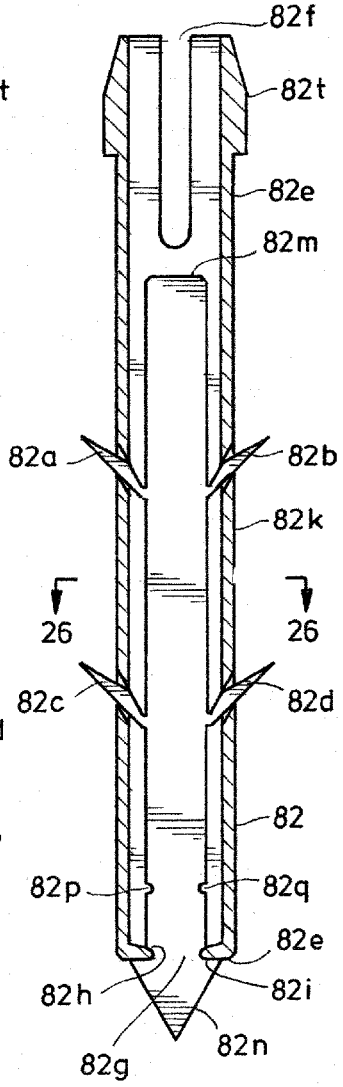
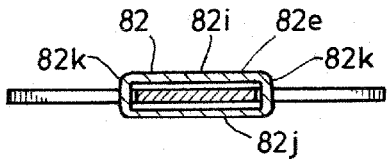
FIG. 26
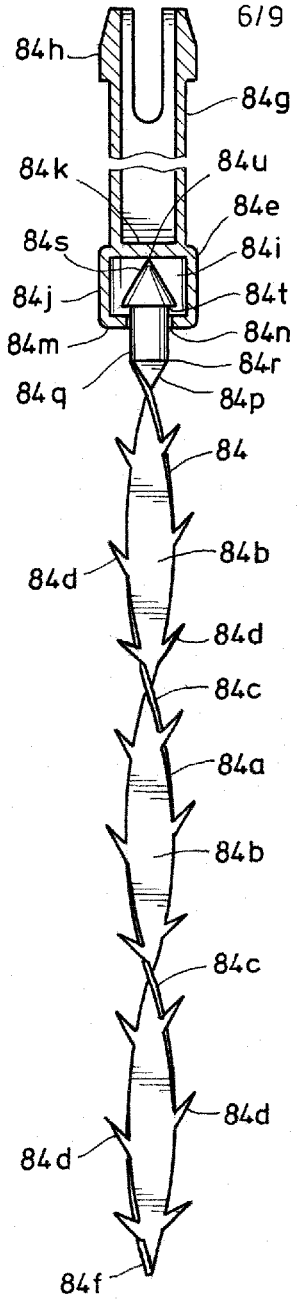
FIG. 27

DRAIN CLEANING APPARATUS

CROSS REFERENCE TO RELATED APPLICATIONS

This application claims priority to and the benefit of U.S. Provisional Patent Application Ser. No. 62/109,743, filed by the present inventors on Jan. 30, 2015, which is incorporated by reference.

BACKGROUND OF THE INVENTION

1. Field of the Invention

The present invention pertains to an apparatus for unclogging a stopped-up drain pipe from a sink, a bathtub, a shower or a toilet, and more particularly to a drain cleaning apparatus that can be assembled to have more than one length and which can be adapted to use different end tools for serving different purposes related to unclogging or cleaning a drain pipe or retrieving an object from a drain pipe or similar restricted space.

2. Description of the Related Art

A drain pipe from a sink, a bathtub, a shower or a toilet often becomes clogged and will not drain properly due to an accumulation of debris, such as hair, toothpaste, solid waste and paper. A drain snake has often been used to unclog a drain pipe, but a drain snake may be more than is needed for a clog that is located relatively close to a drain opening. U.S. Pat. No. 6,775,873, issued to Luoma, is directed to an apparatus for removing from a drain. The Luoma apparatus consists of an elongate, flexible strip that has a handle formed integral on one end of the strip. The strip has barbed portions alternating along the sides of the strip. The strip can be inserted into a drain clogged with an accumulation of hair, and the barbed portions serve to grip the hair so that the hair can be removed from the drain as the strip is pulled out of the drain. The Luoma apparatus may be useful, but its usefulness is limited by its fixed length, its ability to negotiate bends in a drain pipe, its ability to clean hair and other debris from a drain pipe, and it is limited to cleaning hair from a drain pipe and does not provide for serving any other purpose. Consequently, there continues to be a need for an improved drain cleaning apparatus.

SUMMARY OF THE INVENTION

In one embodiment, the present invention provides a drain cleaning apparatus that includes a handle having opposing ends and a grip with one end having a handle connector. A clog-catching member, which has a body with a length, a proximal end, a distal end and a proximal-end connector, is detachably connected to the handle connector with the proximal-end connector. Preferably, a plurality of wings project radially from the body with respect to the longitudinal axis of the body. One option is for the wings to have the appearance, arrangement and orientation of wings on an aircraft, except with multiple sets of wings. The purpose of the wings is to provide an angled projection that will catch onto and hold a clump of debris in a drain pipe so that the clump can be pulled out of the drain. It is preferable for functionality that the handle, the clog-catching member, and the plurality of wings have a combination of strength, stiffness, flexibility and length to enable a user to push the clog-catching member through a drain opening in a sink and into a drain pipe, preferably for unclogging the drain pipe by catching and pulling out of the drain pipe a clog, clump, wad or mass of debris in the drain pipe. The distal end of the clog-catching member preferably has a tool connector.

In a further embodiment, a tool, which has a mechanical device and a member connector, is connected to the tool connector of the clog-catching member in a manner that allows disconnection. For detachable connections, it is preferred that the connectors use a quick-release coupling mechanism, a push-button mechanism, a side-release buckle mechanism or a threaded-connection mechanism. The present invention provides a multifunctional apparatus, which is generally, but not necessarily, used to unclog a clogged drain pipe in a location near a drain opening. Multifunctionality may be provided in part because a wide variety of tools may be removably attached to the clog-catching member or to a similar extension section. The mechanical device of the tool can be any one of any of the following elements or devices: a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, a wisk or a hook.

The present invention provides in one embodiment an apparatus that has one or more sections of an elongate body having at least one of a plurality of wings, barbs or hooks that can be assembled into a number of different lengths and disassembled, which can be used with a handle and, optionally, with a tool on an end opposite the handle. The apparatus of this embodiment can be packaged and sold in retail stores or online as a kit containing the disassembled drain cleaning apparatus, preferably with one or more end tools. The kit may contain a handle having a connector A, at least one clog-snagging member and/or a smooth extension member having an elongate body with a connector B on one end and a connector C on the other end. A tool having a connector D and a size and shape suitable for insertion into a drain pipe from a sink, bathtub or a toilet for unclogging the drain pipe or cleaning the inside of the drain pipe or retrieving an object from inside the drain pipe is preferably included in the kit. A user can assemble the drain-cleaning apparatus by connecting the connector B to the connector A and connecting the connector D to the connector C. The user can use the drain-cleaning apparatus to unclog a drain and then can disassemble the apparatus. The components can be cleaned, stored and re-used or dirty components can be discarded while some components are reused.

Another embodiment of a drain cleaning apparatus includes an elongate body and a plurality of J-shaped or fish-hook-shaped hooks fixed to, embedded in or formed integral with the body near one end, so a user can push the elongate body and the hooks through a drain opening in a sink, bathtub, shower, toilet or similar plumbing fixture and into a clogged drain pipe to fish a clump, wad or mass of debris out of the drain pipe and unclog the drain. One would likely want a handle or a grip on the other end of the body to make it easier to push the body and hooks into the drain pipe and to pull it out, and in one embodiment a detachable handle is provided. A further option is to provide a number of different lengths for the apparatus by using an extension member between the elongate body and the handle, where the extension member is removably connected to the handle, and where the elongate body is removably connected to the extension member. With this option, a user can attach the handle, one or more extension members and the elongate body, which has the hooks, together; unclog a clogged drain pipe; and then disassemble the drain cleaning apparatus. Alternatives to the hooks include an arrowhead, several arrowheads in a row on a shaft, and a spear that either has fixed or retractable barbs.

BRIEF DESCRIPTION OF THE DRAWINGS

A better understanding of the invention can be obtained when the detailed description of exemplary embodiments set forth below is considered in conjunction with the attached drawings in which:

FIG. 10 is a side elevation of a quick-conned connector having a male portion engaged with a female portion, where the male and female portions cannot be disassembled easily, according to the present invention.

FIG. 11 is a cross-section of the quick-connect connector of FIG. 10, as seen along the line 11-11.

FIG. 12 is a side elevation in partial cross-section of first and second portions of a quick-connect connector before the portions are connected together, according to the present invention.

FIG. 13 is a side view of the quick-connect connector of FIG. 12 in partial cross-section as seen from the left and after the first and second portions are connected together.

FIG. 14 is a side of the quick-connect connector of FIG. 13 as seen from the left.

FIG. 15 is a cross-section of the quick-connect connector of FIG. 13 as seen along the line 15-15.

FIG. 24 is a side elevation in cross-section of a barbed spear with its barbs in a retracted position, according to the present invention.

FIG. 25 shows the barbed spear of FIG. 24 with its barbs in an extended position.

FIG. 26 is a cross-section of the barbed spear of FIG. 25 as seen along the line 26-26.

FIG. 27 is a side elevation of a helical barbed spear in partial cross-section, according to the present invention.

DETAILED DESCRIPTION OF THE EXEMPLARY EMBODIMENTS

For a drain pipe from a sink, bathtub, a shower or the like that has become clogged and is not draining properly, the present invention provides an apparatus for cleaning the drain pipe. Drains often become clogged due to an accumulation of debris, and the accumulation of debris is often in the form of a clump that is often a combination of hair and other debris. The apparatus of the present invention in one embodiment is an assembly of parts, which may include a handle, a clog-snagging member and an end piece, that can be used catch and pull a clump of debris from a drain and/or dislodge and break up a clump of debris, which can then be washed down the drain.

Figures 1, 23:
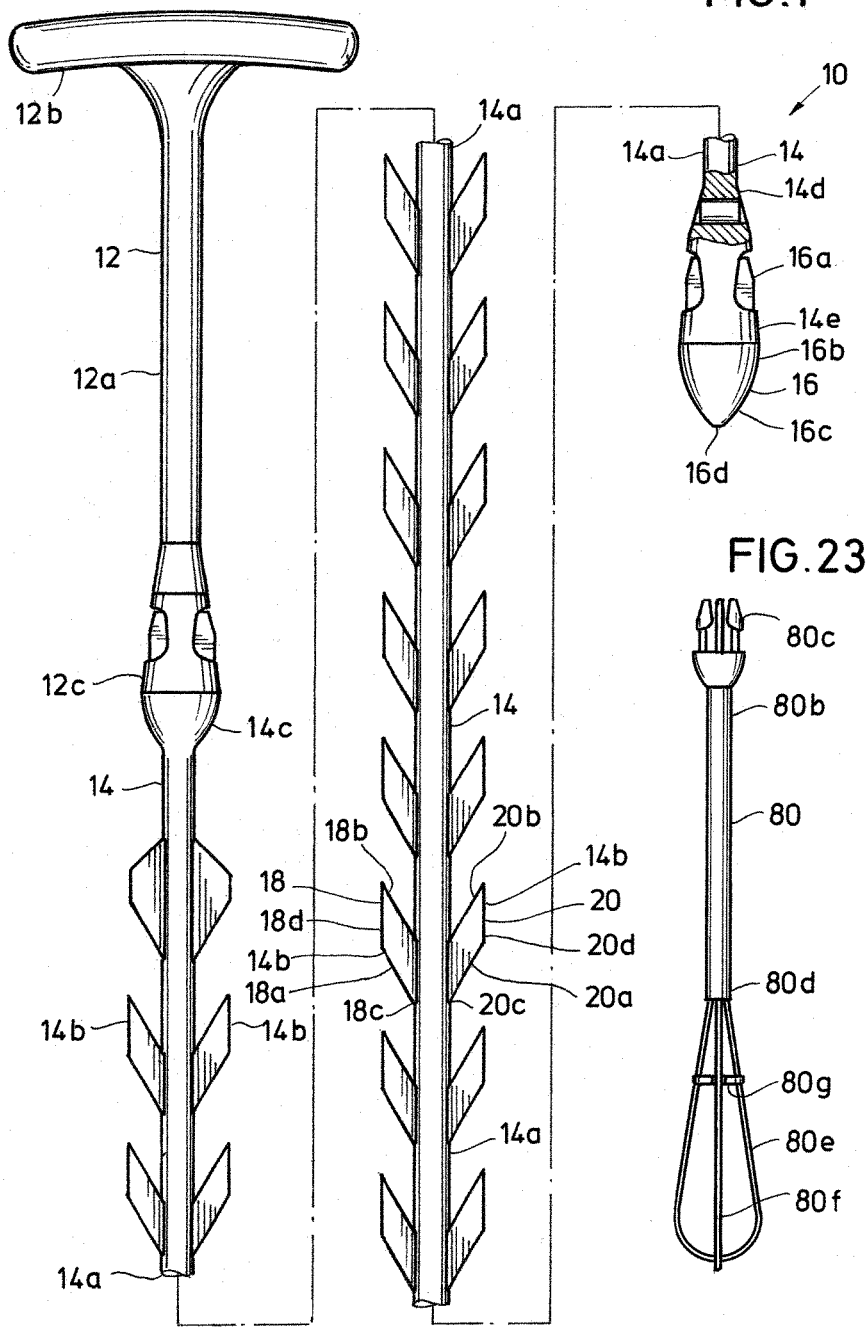
FIG. 1 is a side elevation of a drain cleaning apparatus, according to the present invention.
FIG. 23 is a side elevation of a wisk, according to the present invention.

FIG. 1 is a side elevation of one embodiment of the invention. A drain cleaning apparatus 10 includes a T-shaped handle 12, a clog-snagging or clog-catching member 14, and an end tool 16. Drain cleaning apparatus 10 is an elongated, rod-shaped assembly of parts that has a longitudinal axis. Handle 12 has an elongate portion 12*a* that has a longitudinal axis that is coincident with the longitudinal axis of the drain cleaning apparatus 10. The elongate portion 12*a* of the handle 12 has opposing ends, one of which is a gripping portion 12*b* and the other of which is a handle connector 12*c*. The gripping portion 12*b* in this embodiment is a length of material that has a longitudinal axis that is transverse to the longitudinal axis of the elongate portion 12*a* and is centered on the end of the elongate portion 12*a* so as to form a "T" shape. Other types of grips can be used to provide means for a person to hold handle 12, such as a ball on the end of elongate portion 12*a* or finger grips along the surface of the elongate portion. The gripping portion of the handle can be finger grips on a shaft, finger holes, a smooth, straight shaft or an element having the shape of a Roman numeral for the number one. Handle connector 12*c* can be any suitable connector, which is preferably quick and easy to use and which provides, preferably, a detachable connection. In this embodiment, handle connector 12*c* is a female portion of a side release buckle, which is described in further detail below.

The clog-snagging member 14 in this embodiment includes an elongate, cylindrical rod or body 14*a* and a plurality of wings 14*b*. Body 14*a* has a longitudinal axis coincident with the longitudinal axis of drain cleaning apparatus 10. Wings 14*b* project radially outwardly with respect to the longitudinal axis of body 14*a* of clog-snagging member 14. A handle-end connector 14*c* is detachably connected to the handle connector 12*c* in this embodiment, although handle 12 and clog-snagging member 14 could be made as an integral unit such as by plastic injection molding. Clog-snagging member 14 has a tool end 14*d* and a tool-end connector 14*e*. End tool 16 has a tool connector 16*a* that is detachably connected to the tool-end connector 14*e* of the clog-snagging member 14. End tool 16 has a body 16*b* with the tool connector 16*a* on one end of the body 16*b* and a somewhat rounded portion 16*c* and somewhat pointed end that terminates in a pointed tip 16*d*. End tool 16 may be referred to as a bull nose. The purpose of end tool 16 is to puncture and protrude into and through a clump, wad or mass of debris, which clogs a drain pipe. A user can push the drain cleaning apparatus 10 into a drain pipe clogged by a clump, wad or mass of debris, pass the end tool 16 through the clump, wad or mass of debris, pass at least a portion of the clog-catching member 14 through the clump, wad or mass, and then pull the drain cleaning apparatus 10 out of the drain pipe, while also pulling the clump, wad or mass of debris out of the drain pipe because the clump, wad or mass is caught on and entangled with the wings 14*b* on the clog-catching member 14. Another embodiment of this invention omits the end tool 16, omits the tool-end connector 14*e* on the clog-snagging member 14, and provides simply a tip, which may be a pointed or rounded tip, for the tool end 14*d* of the clog-snagging member 14. Another embodiment further omits the handle connector 12*c* and the handle-end connector 14*c* and provides some type of handle or gripping portion on the clog-snagging section 14, which may be nothing more than an end of the clog-snagging section 14, thereby providing a drain cleaning device that consists essentially of a rod or strip having wings for catching and holding a clump, wad or mass of debris in a drain pipe.

With reference to the clog-snagging member 14 in FIG. 1, wings 14*b* can be barbs or hooks that will catch on a clump of debris for extracting the debris from a drain pipe, but in this embodiment, each wing 14*b* resembles the shape of an airplane wing. Wings 14*b* are arranged in pairs in this embodiment and located on opposite sides of body 14*a*. Wings 14*b* in a typical pair of wings are identified as elements 18 and 20 in FIG. 1 for a more detailed description of the shape and arrangement of the wings. Wings 18 and 20 are typical of wings 14*b*. Body 14*a* preferably has a cross-section in the shape of a circle or oval, although it could have a square or rectangular shape.

For describing the wings 14*b*, the body 14*a* can be thought of like the fuselage of an airplane. Typical wing 18 projects radially outwardly toward the left as shown in FIG. 1, and typical wing 20 projects radially outwardly toward the right from body 14*a* of clog-snagging member 14. Typical wings 18 and 20 are located on opposite sides of body 14*a*, preferably about 180 degrees apart, although this may vary between 160 and 200 degrees, but is preferably within 170 to 190 degrees. Each wing 14*b* has the shape of a parallelogram in this embodiment. Typical wings 18 and 20 have leading edges 18*a* and 20*a* and trailing edges 18*b* and 20*b*, respectively. Typical wings 18 and 20 have inner edges 18*c* and 20*c*, respectively, that are attached to body 14*a*, preferably by being formed as an integral unit, such as by plastic injection molding. Typical wings 18 and 20 have outer edges 18*d* and 20*d*, respectively, which are spaced away from body 14*a*. Outer edges 18*d* and 20*d* are essentially parallel to the longitudinal axis of drain cleaning apparatus. 10. Inner edges 18*c* and 20*c* are essentially parallel to outer edges 18*d* and 20*d*, respectively. Leading edges 18*a* and 20*a* are essentially parallel to trailing edges 18*b* and 20*b*, respectively. The leading edges 18*a* and 20*a* would be the first edges to enter a drain pipe and are father from handle 12 than trailing edges 18*b* and 20*b*, which would enter a drain pipe after the leading edges are pushed into the drain pipe. Lines along leading edges 18*a* and 20*a* intersect within body 14*a* and form a "V" shape, which is like the shape of an arrowhead, where the arrow points away from handle 12. The arrowhead shape of a typical pair of opposing wings 14*b*, as described for typical wings 18 and 20, allows a user to push drain cleaning apparatus 10 into a clump of debris inside a drain pipe and then to pull the apparatus 10 out of the drain pipe with the clump caught on wings 14*b* for extracting the clump from the drain pipe, thereby unclogging the drain pipe.

Figure 2:
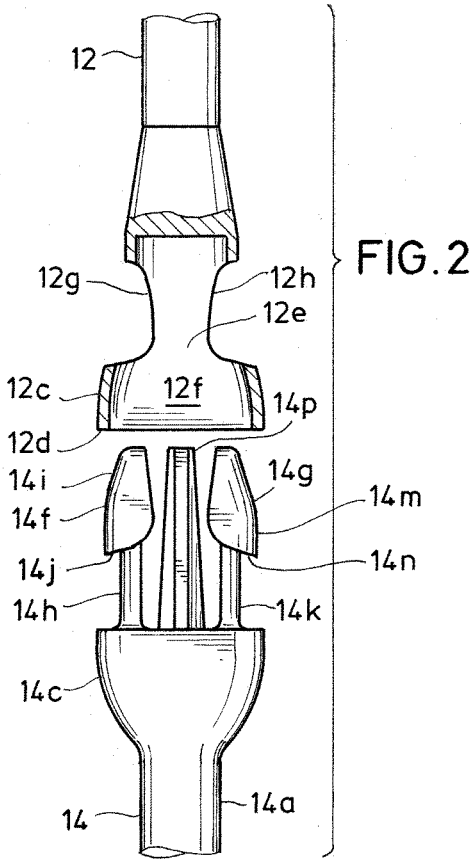
FIG. 2 is a side elevation in partial cross-section of a male portion and a female portion of a quick-connect connector before the portions are connected together, according to the present invention.
Figure 3:
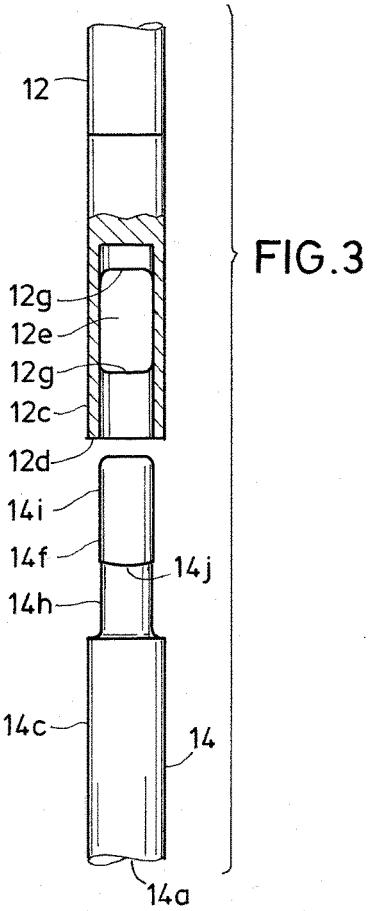
FIG. 3 is a side view of the quick-connect connector of FIG. 2, as seen from the left and in partial cross-section.
Figure 4:
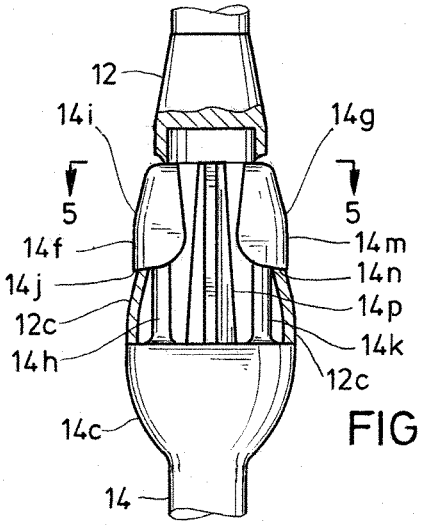
FIG. 4 is a side elevation in partial cross-section of the male portion and the female portion of the quick-connect connector of FIG. 2 after the portions are connected together.

FIGS. 2-5 show a preferred connector that can be used to connect the parts of drain cleaning apparatus 10 together. The connector in FIGS. 2-4 is typical of handle connector 12*c* on handle 12, handle-end connector 14*c* and tool-end connector 14*e* on clog-snagging member 14, and tool connector 16*a* on end tool 16. Reference will be made to the connection between the clog-snagging member 14 and the handle 12 with the understanding that the same type of connector is used for connecting end tool 16 to clog-snagging member 14. FIG. 2 shows portions of handle 12 and clog-snagging member 14 before the two parts are connected together. Handle connector 12*c* is shown in partial cross-section and is a female portion of a connector. Handle connector 12*c* is open at an outer end 12*d*, and a cavity 12*e* is defined by an inside surface 12*f*. Handle connector 12*c* has opposing notched portions 12*g* and 12*h*, which provide side openings into cavity 12*e*. Handle-end connector 14*c* is a male portion of a connector, which has a pair of opposing prongs 14*f* and 14*g*. Prong 14*f* has a shaft portion 14*h*, an enlarged and pointed head portion 14*i* and a shoulder 14*j* defined between the larger-diameter head portion 14*i* and the smaller-diameter shaft portion 14*h*. Prong 14*g* has a shaft portion 14*k*, an enlarged and pointed head portion 14*m* and a shoulder 14*n* defined between the larger-diameter head portion 14*m* and the smaller-diameter shaft portion 14k. Handle-end connector 14*c* also has a central guide post 14*p*.

Figure 5:
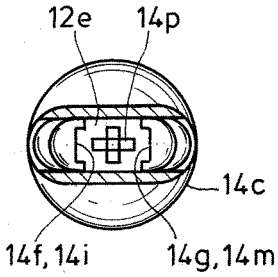
FIG. 5 is a cross section of the connected male and female portions of the connector of FIG. 4, as seen along the line 5-5.
Figure 6:
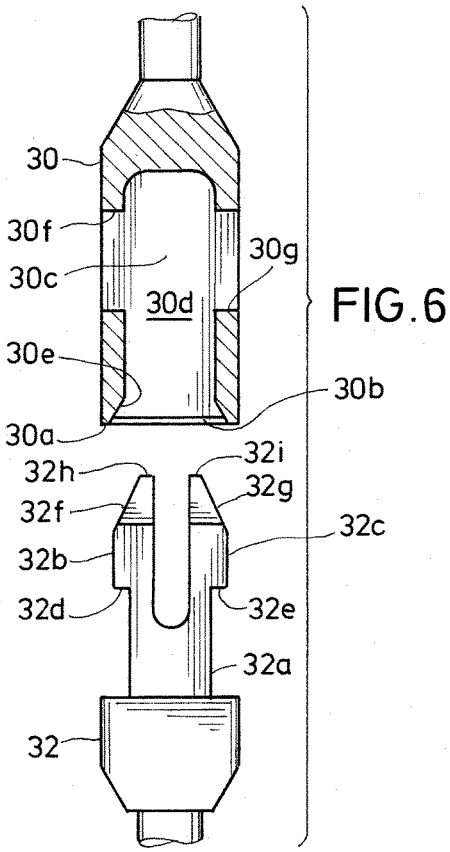
FIG. 6 is a side elevation in partial cross-section of a male portion and a female portion of a quick-connect connector before the portions are connected together, according to the present invention.

FIG. 2 shows portions of handle 12 and clog-snagging member 14 before being connected together and in the same orientation as shown in FIG. 1. FIG. 3 is a view of the connector of FIG. 2 as seen from the left side of FIG. 2. FIG. 4 shows portions of handle 12 and clog-snagging member 14 in partial cross-section connected together and in the same orientation as shown in FIG. 1. FIG. 5 is a cross-section of FIG. 4 as seen along the line 5-5. Clog-snagging member 14 is connected to handle 12 by inserting prongs 14*f* and 14*g* into cavity 12*e* of handle 12. Prongs 14*f* and 14*g* are sufficiently flexible and resilient to bend inwardly as prongs

14*f* and 14*g* are pressed into cavity 12*e* and then snap back to their normal position as head portions 14*i* and 14*m* expand outwardly into notched portions 12*g* and 12*h* of handle connector 12*c*. Shoulders 14*j* and 14*n* of handle-end connector 14*c* engage the notched walls of handle connector 12*c*, thereby connecting and holding clog-snagging member 14 in engagement with handle 12. Clog-snagging member 14 can be disengaged from handle 12 by pressing prong heads 14*f* and 14*g* closer together until shoulders 14*j* and 14*n* lose contact with the side walls of notched openings 12*g* and 12*h* in handle connector 12*c* and pulling prongs 14*f* and 14*g* out of engagement with handle connector 12*c* and clog-snagging member 14 out of engagement with handle 12. End tool 16 and its tool connector 16*a* is detachably connected to the tool-end connector 14*e* of the clog-snagging member 14 in an identical manner using identical elements.

Figure 7:
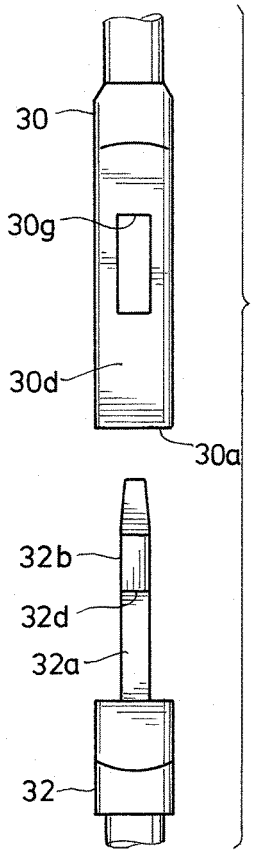
FIG. 7 is a side view of the quick-connect connector of FIG. 6 as seen from the left and in partial cross-section.
Figure 8:
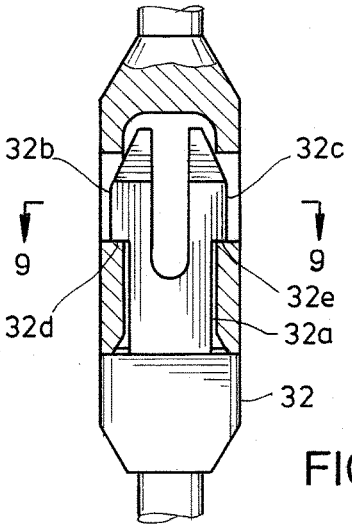
FIG. 8 is a side elevation in partial cross-section of the male portion and the female portion of the quick-connect connector of FIG. 6 after the portions are connected together.
Figure 9:
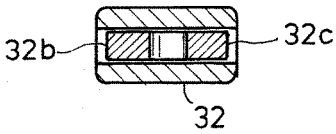
FIG. 9 is a cross section of the connected male and female portions of the connector of FIG. 8, as seen along the line 9-9.

FIGS. 6-9 are analogous to FIGS. 2-5 and illustrate an alternative design for a detachable, quick-connect connector. A female connector 30 is shown in partial cross-section in an orientation as shown for handle connector 12*c* in FIG. 2. A male connector 32 is shown in the same orientation as shown for handle-end connector 14*c* of clog-snagging member 14 in FIG. 2. FIG. 7 is a side view of FIG. 6 like FIG. 3 is a side view of FIG. 2. FIG. 8 shows male connector 32 engaged with female connector 30 for showing two elements connected together in a manner analogous to the description provided with reference to FIG. 4, FIG. 9 is a cross-section of the connectors 30 and 32 of FIG. 8 as seen along the line 9-9, which is analogous to FIG. 5. Female connector 30 has an end 30*a*, which has an opening 30*b* leading into a cavity 30*c* defined by an interior surface 30d. End 30*a* has a beveled edge 30*e* that slopes inwardly toward cavity 30*c* to facilitate receiving male connector 32 within cavity 30*c*. Side openings 30*f* and 30*g* are openings in the outside wall that defines cavity 30*c* and are located opposite one another.

Male connector 32 shown in FIGS. 6-9 has a shaft 32*a* on its end, which terminates in two parallel prongs 32*b* and 32*c* that are spaced apart. Prongs 32*b* and 32*c* are tapered inwardly towards their terminal ends to facilitate penetration into the female cavity 30*c* of female connector 30. Shoulders 32*d* and 32*e* provide a means for a locking engagement after male connector 32 is inserted into female connector 30, as shown in FIG. 8. Prongs 32*b* and 32*c* have tapered outer surfaces 32*f* and 32*g*, which are angled by about the same amount as the beveled edge 30*e*. Prongs 32*b* and 32*c* have outermost tips 32*h* and 32*i*, which have an outer diameter that is smaller than the inner diameter of cavity 30*c* in female connector 30. As prongs 32*b* and 32*c* are pushed into cavity 30, prongs 32*b* and 32*c* flex inwardly until the shoulders 32*d* and 32*e* are pushed inwardly sufficiently for the prongs 32*b* and 32*c* to flex outwardly and thereby couple the male connector 32 to the female connector 30. Connectors 30 and 32 can be disengaged by pressing prongs 32*b* and 32*c* toward one another sufficiently for the shoulders 32*d* and 32*e* to slide outwardly through the cavity 30*c*.

FIGS. 10 and 11 show a quick-connect connector that allows easy assembly, but it is a connector that cannot be easily disassembled. A female connector 34 has features that are very similar to the features of female connector 30 in FIG. 6. Female connector 34 has an end 34*a*, which has an opening 34*b* leading into a cavity 34*c* defined by an interior surface 34*d*. End 34*a* has a beveled edge 34*e* that slopes inwardly toward cavity 34*c* to facilitate receiving a male connector within cavity 34*c*. Side openings 34*f* and 34*g* are openings in the outside wall that defines cavity 34*c* and are located opposite one another. A male connector 36 has an end that terminates in a shaft 36*a*. Tapered wings 36*b* and 36*c* (shown in FIG. 11) have leading tapered edges 36*d* and 36*e*, respectively, which can be seen in FIG. 10. Shoulders 36*f* and 36*g* are defined where the tapered wings 36*b* and 36*c* extend outwardly from the shaft 36*a*. Shaft 36*a* and tapered wings 36*b* and 36*c* are a solid, integral component, unlike the prongs 32*b* and 32*c* of male connector 32 in FIG. 6, which are spaced apart and flexible and resilient. However, with proper clearance and expandability and compressibility of materials, shaft 36*a* of male connector 36 can be forced into cavity 34*c* of female connector 34 to the point that shoulders 36*f* and 36*g* expand into the openings 34*f* and 34*g*, respectively, thereby engaging male connector 36 with female connector 34. However, it is not intended that male connector 36 can be removed from engagement with female connector 34 without some damage to one or both of the connectors.

FIGS. 12-15 illustrate an alternative embodiment of a quick-connect connector that can be disconnected easily. The quick-connect connectors of FIGS. 2 and 6 engaged axially. The quick-connect connector of FIGS. 12-15 engages transverse to the longitudinal axis of the connector. As best seen in FIG. 12, a connector 40 is formed integral with an upwardly extending rod portion 40*a*, and a connector 42 is formed integral with a downwardly extending rod portion 42*a*. Connector 40 has a recessed portion 40*b* along a length of connector 40. A pair of flanges 40*c* and 40*d* project transverse to the longitudinal axis of connector 40 within recessed portion 40*b*. FIG. 13 shows connectors 40 and 42 engaged with one another, and FIG. 15 shows a cross-section of the connectors 40 and 42 as seen along the line 15-15 in FIG. 13. The pair of flanges 40*c* and 40*d* are shown in FIG. 15. Connector 40 has a wall 40*e* on the right in FIG. 15, and flanges 40*c* and 40*d* project to the left from wall 40*e*. An outer edge of each of the flanges 40*c* and 40*d* taper in a manner for insertion into an opening that squeezes the flanges 40*c* and 40*d* toward each other. Recesses 40*f* and 40*g* are formed in the outer walls of flanges 40*c* and 40*d* respectively. Shoulders 40*h* and 40*i* are defined adjacent to recesses 40*f* and 40*g*, respectively.

Connector 42 in FIG. 12 has a recessed cavity 42*b*, which can also be seen in FIG. 15. Connector 42 has an opening 42*c* facing connector 40, which may be best seen in FIG. 14. Opening 42*c* is narrower than cavity 42*b* due to projections 42*d* and 42*e* that project inwardly toward one another and define opening 42*c*. Projections 42*d* and 42*e* are sized to fit within recesses 40*f* and 410, respectively, of connector 40. Flanges 40*c* and 40*d* of connector 40 are sized and designed to be received in the recessed cavity 42*b* of connector 40 through opening 42*c* by a force fit that squeezes flanges 40*c* and 40*d* toward one another after which flanges 40*c* and 40*d*, which are resilient, return to normal, thereby engaging the shoulders 40*h* and 40*i* of flanges 40*c* and 40*d* with the projections 42*d* and 42*e* of connector 42, as can be seen in FIG. 15. An identical grouping of cavity, opening and projections as found on connector 42 is provided on connector 40. identical grouping of flanges and recesses as found on, connector 40 is provided on connector 42. The flanges on connector 40 are pressed into the cavity in connector 42 at about the same time as flanges on connector 42 are pressed into the cavity in connector 40, thereby engaging connector 42 with connector 40. Connector 42 can be detached from connector 40 by squeezing the flanges together. With reference to FIG. 15, a screwdriver can be inserted into space A to disengage flanges 40*c* and 40*d* of connector 40 from connector 42 at that point of engagement and similarly for the other point of engagement.

Figures 16, 17, 18, 19, 20, 21, 22:
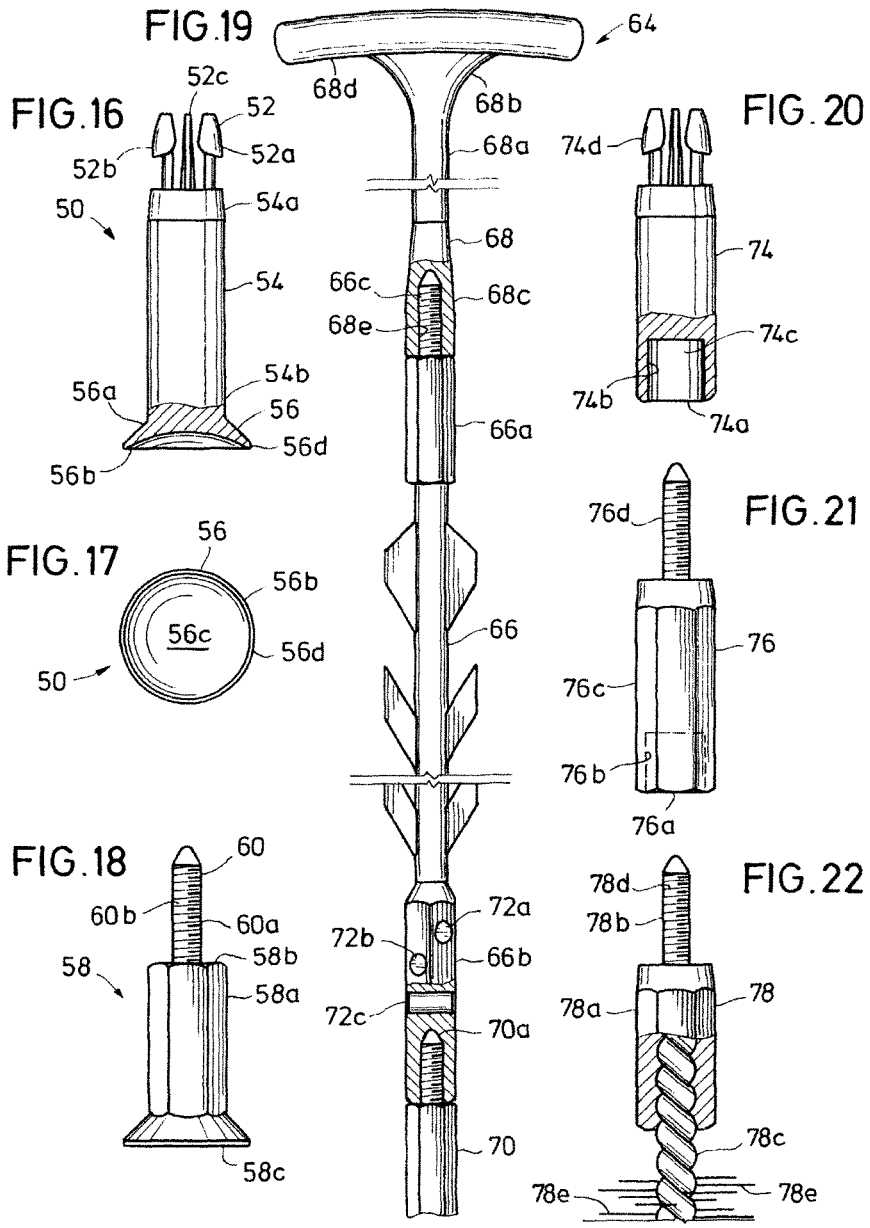
FIG. 16 is a side elevation of a pusher/scraper tool having a male, two-pronged quick-connect connector, according to the present invention.
FIG. 17 is a bottom end view of the pusher/scraper tool of FIG. 16.
FIG. 18 is a side elevation of a pusher/scraper tool having a screw for detachable attachment to another element, according to the present invention.
FIG. 19 is a side elevation of a drain cleaning apparatus having elements detachably connected together using screws and having magnets in a tool end, according to the present invention.
FIG. 20 is a side elevation of an end tool having a cavity in which a magnet is received and having a male, two-pronged quick-connect connector, according to the present invention.
FIG. 21 is a side elevation of an end tool having a cavity in which a magnet is received and having a screw connector, according to the present invention.
FIG. 22 is a side elevation of an end tool having a body, a brush received in one end of the body and a screw connector on the other end of the body, according to the present invention.

FIG. 16 is a side elevation of a pusher/scraper tool 50, which is a tool that can be connected to clog-snagging member 14 instead of end tool 16. Pusher/scraper tool 50 has a quick-connect tool connector 52, which can be inserted into the tool-end connector 14*e* of the clog-snagging member 14. Tool connector 52 has a pair of prongs 52*a* and 52*b* and a central guide post 52*c*. Pusher/scraper 50 has an elongated body 54, which typically, but not necessarily, has a cross-section that is circular or oval in shape. Body 54 has a connector end 54*a*, and tool connector 52 is attached to the body 54 at the connector end 54*a*, preferably by being formed integral with body 54, such as by plastic injection molding. Body 54 has a working end 54*b*, and a pusher/scraper element 56 is attached to the working end 54*b* of the body 54, preferably by integral formation, but possibly by quick-connect connection, including by a threaded connection. The pusher/scraper element 56 has a body end 56*a*, which has a size and/or diameter that is the same as that of body 54, and an outer end 56*b*, which has a diameter that is about the same or slightly more or less than that of a drain pipe that is to be worked on with the drain cleaning apparatus of the present invention. Pusher/scraper element 56 flares outwardly and has a conical shape in this embodiment between body end 56*a* and outer end 56*b*. FIG. 17 is an end view of pusher/scraper tool 50 looking at the outer end 56*b* of the pusher/scraper element 56. The outer end 56*b* of the pusher/scraper element 56 has a surface 56*c* that has concave, bowl shape. The outer end 56*b* of the pusher/scraper element 56 has an outer circumference 56*d*.

Pusher/scraper tool 50 is used to clean the inside of a drain pipe, dislodging debris adhered to the inside of the drain pipe. A user assembles the drain cleaning apparatus to have a handle 12, at least one clog-snagging member 14, but possibly several clog-snagging members connected end to end, and the push/scraper tool 50 is attached to the end of the clog-snagging member 14 that is away from the handle 12. The user inserts the pusher/scraper tool 50 into a drain pipe that is be cleaned and pushes the pusher/scraper tool 50 through the drain pipe as the clog-snagging member is inserted into the drain pipe. The pusher/scraper element 56 is preferably in close contact with the inside wall of a drain pipe that is to be cleaned. The outer circumference 56*d* of the pusher/scraper element 56 is preferably sized to fit snugly inside the drain pipe. The outer circumference 56*d* of the pusher/scraper element 56 scrapes the inside wall of the drain pipe as the user pushes the pusher/scraper tool 50 into the drain pipe. Debris is scrapped off the inside wall of the drain pipe, collected into the bowl-shaped end surface 56*c* of the pusher/scraper element 56 and pushed downstream away from the opening of the drain pipe. The user can insert the pusher/scraper tool 50 into the drain pipe as far as desired by adding additional clog-snagging members to extend the length of the drain cleaning apparatus. After pushing the pusher/scraper tool 50 into the drain pipe as far as desired, the user pulls the drain cleaning apparatus out of the drain pipe and runs water through the drain pipe to flush the dislodged debris into a downstream portion of a plumbing system. The drain cleaning apparatus can be disassembled, cleaned and stored for a subsequent use, or it can be discarded.

FIG. 18 is a side elevation of a pusher/scraper tool 58, which is similar in structure and functionality to the pusher/scraper tool 50 in FIGS. 16 and 17, except pusher/scraper tool 58 has a threaded connector 60 instead of the quick-connect tool connector 52 used with pusher/scraper tool 50. The pusher/scraper tool 58 has a body 58*a*, a connector end 58*b* and an opposing pusher/scraper end 58*c*. A cross-section of the body 58*a* has a hexagonal shape and is preferably sized to receive a standard-sized wrench for threading pusher/scraper 58 into a clog-snagging member or into a handle or extension member. Threaded connector 60 has an elongate body 60*a*, which has male threads 60*b* on its outer surface.

FIG. 19 shows a side elevation of an embodiment 64 of a drain cleaning apparatus, according to the present invention, in which threaded connections are used to detachably connect a clog-snagging section 66 to a handle element 68. A tool element 70 is connected to an end of the clog-snagging section 66 opposite the end where section 66 is connected to handle element 68. The handle element 68 has an elongate body 68*a*, which has opposing ends 68*b* and 68*c*. A grip 68*d* is attached to the end 68*b* to provide a T-shaped handle for convenience in use. Any suitable element can be used as a handle for allowing a user to grip and use the drain cleaning apparatus. A user can grip an end of a clog-snagging member and use the end as a handle. The end 68*c* is opposite of the gripping end 68*b* and preferably has a bore 68*e*, which provides an opening on end 68*c*. The bore 68*e* is an elongate cavity having a longitudinal axis coincident with the longitudinal axis of elongate body 68*a*. The body 68*a* may or may not have female threads on an interior surface that defines bore 68*e*.

The clog-snagging section 66 has a handle end 66*a* and an opposing tool end 66*b*. A screw 66*c* is embedded in the handle end 66*a* of the clog-snagging section 66. Screw 66*c* can be threaded into the handle end 66*a* of the clog-snagging section 66, or it can be molded into the clog-snagging section 66 as the section is formed. Screw 66*c* is preferably made of metal while the clog-snagging section is preferably made of plastic. It is preferable that the body 68*a* of the handle element 68 have bore 68*d*, but screw 66*c* can be a self-threading screw that can be threaded into a solid body 68*a*. If handle element 68 is made of a pliable plastic with a bore, it is not necessary for the bore to be defined by female threads. Screw 66*c* can thread into a bore defined by smooth walls. The clog-snagging section 66 can be connected to handle element 68 by screwing screw 66*c* into handle element 68 and can be disconnected by unscrewing screw 66*c*. Similarly, the tool element 70, which can be any of the tools described herein as well as other suitable tools, has a male screw 70*a* that can be threadedly connected and disconnected from the tool end 66*b* of the clog-snagging section 66. A screw system is a detachable connector that is an alternative to the other quick-connect connectors described in FIGS. 2-15. The screw system of FIG. 19 and the connectors of FIGS. 2-15 are all considered to be quick-connect connectors for the present description.

FIG. 19 illustrates a further embodiment of the present invention in that magnets 72*a*, 72*b* and 72*c* are embedded in the tool end 66*b* of the clog-snagging section 66. This embodiment of a clog-snagging section provides a tool for a user to retrieve an object that is susceptible to magnetic attraction. For example, if an iron-based screw is inadvertently dropped into a drain pipe connected to a sink, the screw will likely be caught in a P-trap. The embodiment 64 of the present drain cleaning apparatus can be inserted into the drain pipe and into the P-trap, and the lost screw should magnetically attach to one of the magnets 72*a*, 72*b* or 72*c* for retrieval. Tool end 66*b* and handle end 66*a* each have a cross-section that is hexagonal in shape for receiving a wrench to hold or turn clog-snagging section 66. The magnets 72*a*, 72*b* and 72*c* are received in different faces of the hexagonal shape of tool end 66*b* of clog-snagging section 66.

FIG. 20 is a side elevation of an end tool 74 that has a cavity 74*a* in which a magnet can be received. Cavity 74*a* is a bore defined by a cylindrical inside wall 74*b*. A magnet 74*c* can be glued into the cavity 74*a* or held in place by a force-fit. An outer surface of magnet 74*c* is visible in FIG. 20 because end tool 74 is shown in partial cross-section. End tool 74 has a two-pronged quick-connect male connector 74*d* that can be connected to a clog-snagging element, as described with reference to FIGS. 2-5.

FIG. 21 is a side elevation of an end tool 76 that has a cavity 76*a* in which a magnet can be received. Cavity 76*a* is a bore defined by a cylindrical inside wall 76*b*. A magnet is received in cavity 76*a* in the same manner as described with reference to FIG. 20. End tool 76 has a body 76*c* and a screw 76*d*, which has male threads on an external surface, protruding from an end of the body 76*c* opposite of the cavity 76*a*. Magnetic end tool 76 can be threadedly connected to and disconnected from a handle, a clog-snagging member or an extension rod. An extension rod can be similar to a clog-snagging member as far as providing a length of material with connection points on the ends, but without wings for snagging hair and other debris.

FIG. 22 is a side elevation of an end tool 78, which has an elongate body 78*a*, a screw 78*b* protruding from one end of body 78*a* and a brush 78*c* protruding from the other end of body 78*a*. Screw 78*b* has male threads 78*d* on an outer surface. Male threads 78*d* can be a self-threading type of thread for connection to a pliable plastic body of material. Brush 78*c* is shown in part and has a plurality of bristles 78*e*.

FIG. 23 is a side elevation of an end tool that is a wisk 80, which includes a tubular body 80*a* having a connector end 80*b* and a male, quick-release connector 80*c* on the connector end. The tubular body has an opposing open end 80*d*. Two or more wires are looped with ends retained inside the tubular body 80*a* and loops 80*e* and 80*f* outside of the tubular body. A spacer 80*g* separates and holds the loops 80*e* and 80*f* in a desired position. The loops 80*e* and 80*f* form what is referred to here as a wisk, and the tool 80 is referred to as a wisk. The wisk can be used to dislodge debris adhered to an inside wall of a drain pipe and to break up a clump of debris in a drain pipe.

FIGS. 24-26 illustrate a barbed spear 82 that has retractable barbs 82*a*, 82*b*, 82*c* and 82*d*. FIG. 24 is a side elevation in cross-section of the barbed spear 82 with the barbs 82*a*, 82*b*, 82*c* and 82*d* in a retracted position. FIG. 25 is a side elevation in cross-section of the barbed spear 82 with the barbs 82*a*, 82*b*, 82*c* and 82*d* in an open and extended position. FIG. 26 is a cross-section of the barbed spear 82 as seen along the line 26-26 in FIG. 25. Barbed Spear 82 has a tubular body 82*e* that has a cross-section what is rectangular in shape, as can be seen in FIG. 26. The tubular body has open ends 82*f* and 82*g*. The opening 82*g* is made smaller by shoulders 82*h* and 82*i* that protrude from a bottom edge of the lower end of body 82*e* into the opening 82*g*. As a rectangular tube, body 82*e* has broad sides 82*j* and narrow sides 82*k*. The narrow sides 82*k* have two pairs of opposing slots. Barbs 82*a* and 82*b* are received in the first pair of opposing slots, and barbs 82*c* and 82*d* are received in the second pair of opposing slots. Barbed spear 82 is preferably made of a plastic, although it could be made of a metal. A strip 82*m* having an arrowhead-shaped end 82*n* is received inside the tubular body 82*e* with the arrowhead end 82*n* outside. Barbs 82*a*, 82*b*, 82*c* and 82*d* are connected to strip 82*m* by flexible hinges. Outer edges of barbs 82*a*, 82*b*, 82*c* and 82*d* form a very acute triangular shape, and the base of the triangle is hinged to the strip 82*m* or formed integral with the strip and of a flexible material. The strip 82*m* has a first set of detent notches 82*p* and 82*q* on opposing edges of the strip across from one another and spaced a short distance away from the arrowhead end 82*n*. The strip 82*m* has a second set of detent notches 82*r* and 82*s* on opposing edges of the strip across from one another and adjacent to the arrowhead end 82*n*. The shoulders 82*h* and 82*i* that protrude from the bottom edge of the lower end of the body 82*e* and into the open end 82*g* function as detent protuberances that with the detent notches for holding the strip 82*m* in a fixed, but temporary, position. Barbed spear 82 has a male connector 82*t* like the connector described for FIGS. 6-9, which provides a quick-connector connector for connection to a handle, a clog-snagging-member or an extension rod. Barbed spear 82 could instead be connected with connector of FIGS. 10 and 11, the threaded connections of FIG. 19 or a different type of quick-connect connector.

The drain cleaning apparatus with the barbed spear 82 of the present invention is deployed into a drain with strip 82*m* fixed in position by engagement of shoulders 82*h* and 82*i* with detent notches 82*p* and 82*q*, respectively, which are spaced away from arrowhead end 82*n*, and arrowhead end 82*n* protrudes from the tubular body 82*e* with barbs 82*a*, 82*b*, 82*c* and 82*d* retracted into tubular body 82*e*. When barbed spear 82 encounters a clump, wad or mass of debris and is pushed into the clump of debris, strip 82*m* is pushed further inside the tubular body until shoulders. 82*h* and 82*i* engage with detent notches 82*r* and 82*s*, respectively, which are proximate to or adjacent to the arrowhead end 82*n* of the strip 82*m*. As the strip 82*m* is pushed into the tubular body, barbs 82*a*, 82*b*, 82*c* and 82*d* engage a portion of the narrow side walls 82*k* of the rectangular, tubular boy 82*e* that defines the opposing slots in the narrow side walls 82*k*, which causes the barbs 82*a*, 82*b*, 82*c* and 82*d* to extend radially outwardly from the retracted position shown in FIG. 24 to the extended, position shown in FIG. 25. The barbs 82*a*, 82*b*, 82*c* and 82*d* pass into or through the wad or mass of debris, after which the drain cleaning apparatus can be pulled out of the drain, while the barbs 82*a*, 82*b*, 82*c* and 82*d* catch and hold the clump, wad or mass of debris, which often includes hair entangled with other debris, for extraction and removal from the drain pipe.

FIG. 27 is a side elevation of a helical spear 84 that has a body 84*a* that is preferably an elongate strip that has a cross-section rectangular in shape. The rectangular shape provides opposing broad sides 84*b* and opposing narrow sides 84*c*. The narrow sides 84*c* have many barbs 84*d* spaced along the length of the body 84*a*. Helical spear 84 can have a male quick-connector like the one described for FIGS. 6-9 on one end, but any suitable connector can be used. FIG. 27 illustrates a rotatable connector 84*e*, which allows the body 84*a* to rotate about its longitudinal axis. The other end of the helical spear 84 terminates in a point 84*f*. The rotatable connector 84*e* has an elongate body 84*g* with a male, quick-connect connector 84*h* on one end and an enclosed space 84*i* on its opposing end. The enclosed space 84*i* is defined by a cylindrical wall 84*j*, a separator wall 84*k* between connector 84*h* and cylindrical wall 84*j*, and a lower wail 84*m*. The lower wall 84*m* has a cylindrical opening 84*n*. Body 84*a* of the helical spear 84 has an upper end 84*p* opposite the point 84*f*. The upper end 84*p* has an elongate shaft 84*q*, which has end 84*r* attached to the body 84*a* of the elongate strip, and the shaft 84*q* has a circular cross-section. The shaft 84*q* has an upper end that terminates is a conical member 84*s*. A shoulder 84*t* is defined and formed because the conical member 84*s* has a diameter greater than the diameter of the shaft 84*q*. The conical member 84*s* tapers into a point 84*u* opposite the shoulder 84*t*. The conical member is received in the enclosed space 84*i*, and the shoulder 84*t* abuts the lower wall 84*m*, which retains the conical member 84*s* inside the enclosed space 84*i*. Shaft 84*q* can rotate within the opening 84*n*. As a user pushes the helical body 84*a* into a clump, wad or mass of debris, a rotational force may be applied to the helical body 84*a*, and since shaft 84*q* can rotate, the helical body 84*a* can rotate.

A drain cleaning apparatus fitted with the helical spear 84 according to the present invention can be inserted into a clogged drain, where the point 84*f* can protrude or poke into a clog, clump or mass of debris, where the barbs 84*d* can catch and hold the clump of debris, so that the clump of debris can be pulled out of the drain to unclog the drain. The helical shape is believed to allow the helical spear to negotiate bends in the drain pipe better than a tube having a circular or rectangular cross-section or a strip having a rectangular cross-section. The helical shape is also believed to allow the helical spear to clean inside walls of the drain pipe better than other designs n some cases. The helical shape can also be expanded to have a greater radius and circumference and to have more the shape of a corkscrew or a spiral in addition to or instead of the twisting. Helical spear 84 can also be made as a strip having a rectangular cross-section, a fixed length and an integral handle portion, much like the drawing in FIG. 27, except with a handle instead of the connector 84*e* and with a desired length, which may be about 30 to 50 inches, preferably about 36 inches (75 to 125 cm, preferably about 90 cm).

Figure 28:
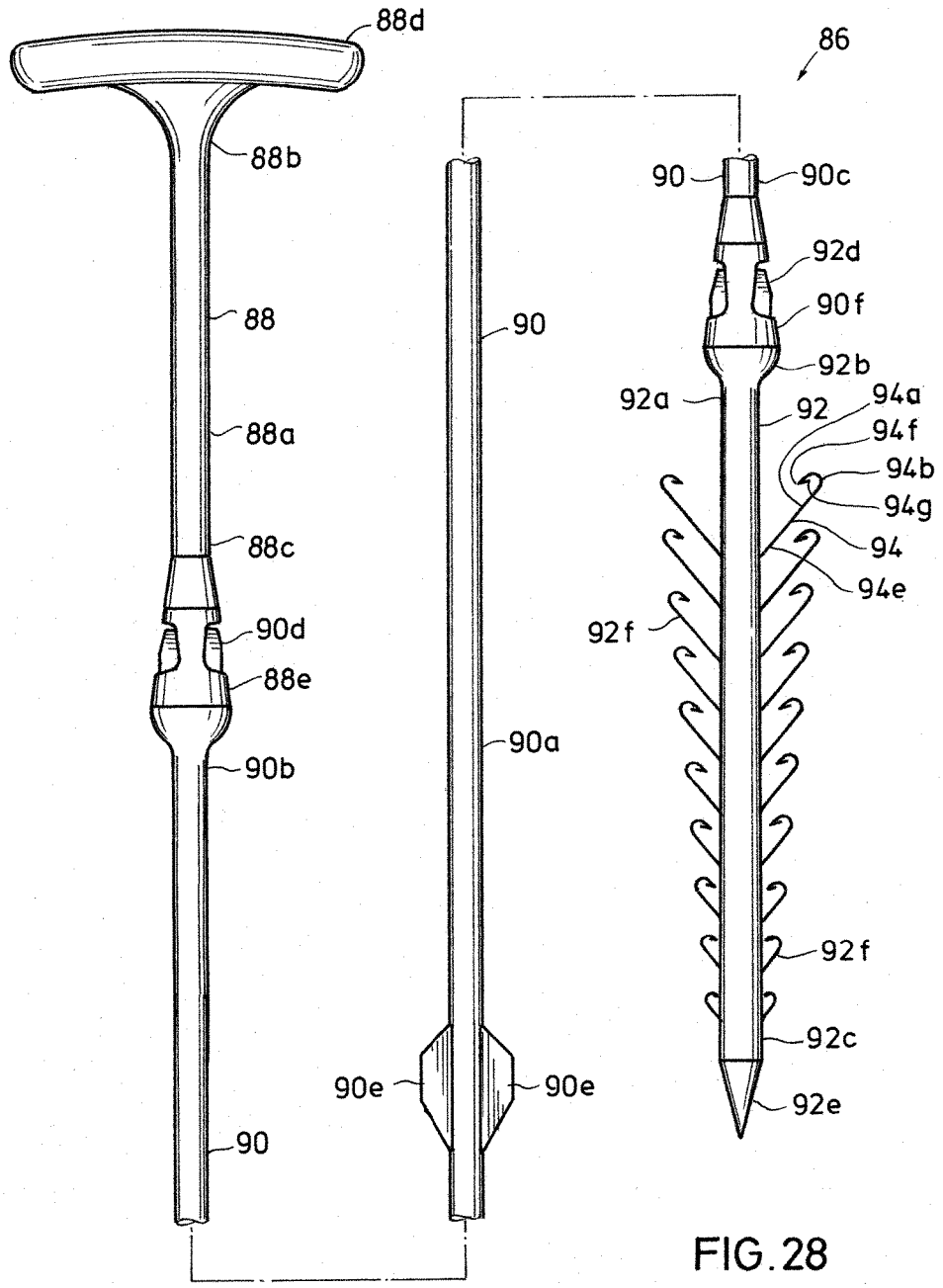
FIG. 28 is a side elevation a drain cleaning harpoon, according to the present invention.

FIG. 28 is a side elevation of another embodiment of the present invention. A drain cleaning apparatus 86 includes a T-shaped handle 88, an extension member 90, and a harpoon 92. Drain cleaning apparatus 86 is illustrated as having a T-shaped handle, but no grip or handle is required, and any kind of grip or handle can be used. Handle 88 has an elongate body 88*a* with opposing ends 88*b* and 88*c*. A gripping element 88*d* is attached transverse to the body 88*a* on the end 88*b*. A female, quick-connect connector 88*e* is attached to or formed integral with the body 88*a* on the end 88*c*. The extension member 90 has an elongate body 90*a*, an end 90*b* proximate to the handle 88 and an opposing end 90*c*. The end 90*b* of the extension member 90 has a male, quick-connect connector 90*d*, which is engaged with and coupled to the female, quick-connect connector 88*e* on the handle 88. The extension member 90 has guide fins 90*e*, which provide a guide through a drain pipe, which centers the extension member in the drain pipe and tends to keep the harpoon 92 from catching on joints in the drain pipe as the harpoon 92 is pulled out of the drain pipe. The extension member 90 has a female, quick-connect connector 90*f* on its end 90*c*. Extension member 90 is shown and described in FIG. 28 as a smooth rod, but the clog-snagging or clog-catching member 14 in FIG. 1, which has the plurality of wings 14*b*, could be used instead.

Harpoon 92 has a central elongate body 92*a*, an end 92*b*, where harpoon 92 connects to the extension member 90, and an opposing end 92*c*. End 92*b* has a male, quick-connect connector 92*d*, which is engaged with and coupled to the female, quick-connect connector 90*f* on the extension member 90. The opposing end 92*c* terminates in a pointed tip 92*e*. The body 92*a* has a cross-section that is circular or oval in shape. Two rows of barbs 92*f* preferably having the shape of fish hooks, are located along the length of the body. The rows of barbs 92*f* are separated from one another by about 160 to 200 degrees, preferably by about 170 to 190 degrees and more preferably by about 180 degrees. A hook is a device that is bent or curved and used to catch and hold something.

A preferred and typical fish-hook shaped barb 94 is described as follows for all of the barbs 92*f*. The fish-hook shaped barb 94 has an inner curved surface 94*a* that has the shape of the inside of the letter "J," where the bottom portion of the letter "J" is an inwardly curved hook. Fish-hook shaped barb 94 has a smooth outer curved surface 94*b*, which has the shape of an arc of a circle. A proximal end 94*c* is attached to, fixed to, embedded in or formed integral with the body 92*a* of the harpoon 92. A distal end 94*f* of typical barb 94 terminates in a sharp, angular projection 94*g*, which is a definition of a barb. One end of the projection 94*g* is coincident with the distal end 94*f* of barb 94, and the other end of projection 94*g* extends inwardly toward the inner curved surface 94*a*, thereby providing a hook on the distal end 94*f* of the typical barb 94, which tends to securely connect the barb 94 to something through which the distal end 94*f* passes. A fish hook can be described as a device that has for centuries been used to catch fish, which has a point for penetrating a fish's mouth or flesh; a barb, which is a projection that extends away from the point and which secures the fish from unhooking; an eye, which is on end opposite the point and is used to connect the fish hook to a fishing line or a fishing lure; a shank, which is the portion of the hook that connects the point and the eye; a bend-or curved portion in the shank near the point; and a gap, which is the distance between the shank and the point in the bend. The description of a fish hook quite literally describes the typical fish-hook shaped barb 94. The fish-hook shaped barbs 92*f* are oriented to place the smooth outer curved surface 94*b* towards the outer, pointed tip 92*e* of the body 92*a* of the harpoon 92. The distal end 94*f* of typical barb 94 is farther away from the outer tip 92*e* than is the proximal end 94*e* of the barb 94 because barb 94 is placed at an acute angle with respect to the longitudinal axis of the body 92*a*. The proximal end 94*e* of the typical barb 94 is embedded in or attached to or formed integral with the body 92*a* and is closer to the outer tip 92*e* of the harpoon 92 than is the distal end 94*f*, which is closer to the handle 88 of the drain cleaning apparatus 86. Barbs 92*f* closest to the outer tip 92*e* are shorter than are barbs 92*f* closer to the end 92*b*, where the harpoon 92 connects to the extension member 90. Barbs 92*f* gradually get longer between a shortest barb 92*f* proximate to the outer tip 92*e* and a longest barb 92*f* proximate to the end 92*b*, where the harpoon 92 connects to the extension member 90. Consequently, a profile of the outer edges of the harpoon 92 has a shape similar to or the same as an isosceles triangle, which has at least two sides of equal length, which here is along an outer profile of the barbs 92*f*, and a base, which here is proximate to the connection of the harpoon 92 to extension member 90.

Harpoon 92 has been described as practically two-dimensional because in one embodiment harpoon 92 is made using plastic injection molding, which is more appropriate for objects that are somewhat two-dimensional. Body 92*a* of harpoon 92 could be a strip having a cross-section that is rectangular in shape. Harpoon 92 can have barbs 92*f* arranged around the circumference of body 92*a*, depending on the manufacturing process chosen. The embodiment of harpoon 92 illustrated in FIG. 28 is preferably made using injection molding with a polymer that will yield barbs 92*f* that are stiff, but flexible, and resilient, somewhat like the bristles on a hair brush or toothbrush that has stiff bristles. One can consider the materials and the methods for manufacturing toothbrushes, hair brushes, cleaning brushes and brooms for determining a preferred method for making harpoon 92. Possible materials to use in making barbs 92*f* and/or harpoon 92 include nylon, an acrylic, polyethylene, polypropylene, polystyrene and a styrene-butadiene rubber, particularly a styrene-butadiene rubber with a high styrene content for stiffness.

Figure 31:
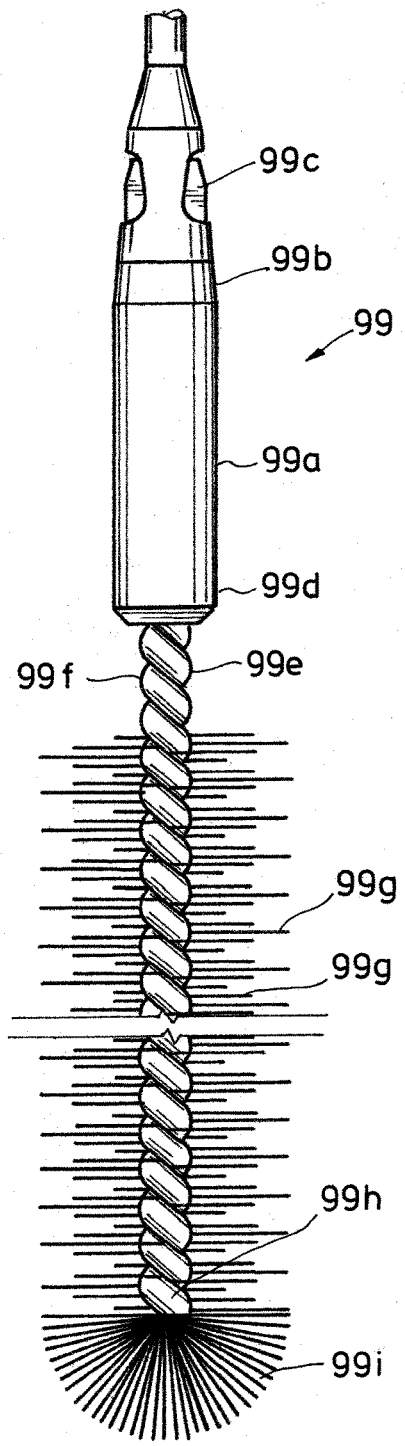
FIG. 31 is a side elevation of a brush, according to the present invention.

Harpoon 92 could instead be made using a pair of twisted wires as illustrated by the brush described as one of the possible end tools of the present invention, such as in FIG. 31. Making the harpoon using twisted wires rather than injection molding could produce a harpoon with fish-hook-shaped or J-shaped bristles spaced around the full circumference of the twisted wires. The bristles would be placed across, transverse, one wire; a second wire would be placed over the bristles; and the wires twisted to secure the bristles between the wires. A single wire that is looped would likely be used rather than two individual wires. It may be possible to use plastic for the wires rather than metal and heat the brush to fuse the plastic wires and bristles into a more integral unit. A challenge in using twisted wire is getting the hooks in a desired orientation.

A user, who has a drain pipe from a sink, bathtub, shower, toilet or similar plumbing fixture clogged by is clump, wad or mass of debris, can insert the harpoon 92 into the drain pipe through a drain opening using one or more extension members 90 connected to the harpoon 92, preferably with a handle 88. The user pushes the drain cleaning apparatus 86 into and through the drain pipe until the outer, pointed tip 92*e* is pushed through the clump, wad or mass of debris that is clogging the drain pipe. The smooth outer curved surface of the fish-hook shaped, barbs 92*f* allow the barbs 92*f* to slide somewhat easily into and/or through the clump, wad or mass of debris. As the barbs 92*f* are pushed into the clump, wad or mass of debris, the barbs 92*f* tend to fold or collapse inwardly toward the body 92*a*, somewhat resembling a straight, closed umbrella. After the user has pushed the harpoon 92 and its barbs 92*f* into and/or through the clump, wad or mass of debris that clogs the drain pipe, the user can gently pull the drain cleaning apparatus 86 of FIG. 28 out of the drain pipe. As the user pulls the harpoon 92 backwards toward the drain opening, the barbs 92*f* tend to open like an umbrella, and the curved portions of the barbs 92*f* catch on and hold the components of the clump, wad or mass of debris so that the debris can be pulled out of the drain pipe and out of the drain opening. If hooks are provided on the distal ends of the barbs 92*f*, which is preferred but optional, the clump, wad or mass of debris is even more securely attached to the harpoon 92 than if hooks, such as formed with projection 94*g*, are not used. Hooked, or merely curved, barbs will tend to catch on and hold components in a clump, wad or mass of debris, particularly if hair is one of the components in the debris.

Figure 29:
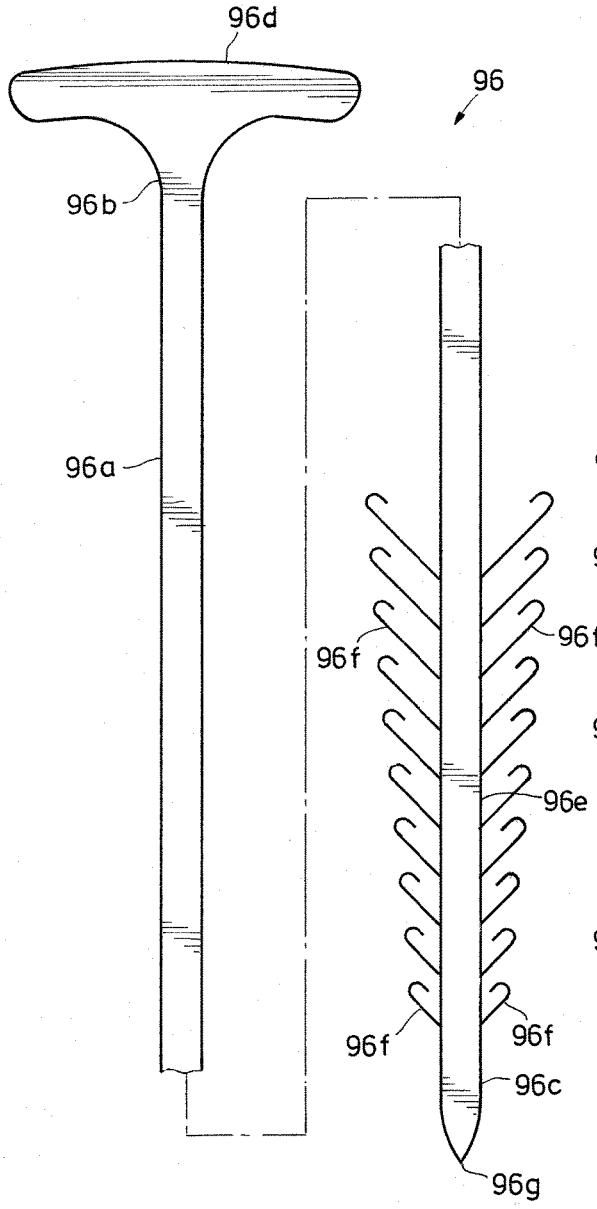
FIG. 29 is a side elevation a drain cleaning harpoon, according to the present invention.

FIG. 29 is a side elevation of a different embodiment of the present-invention for a harpoon. A drain cleaning apparatus 96 includes an elongate strip 96*a* having opposing ends 96*b* and 96*c*, which preferably, but not necessarily, has a T-shaped handle 96*d* formed integral with the strip 96*a* on its end 96*b*. Drain cleaning apparatus 96 is illustrated as having a T-shaped handle 96*d*, but no grip or handle is required and any kind of grip or handle can be used. Rounded ridges and valleys on a straight rod as finger grips or a rounded ball would be suitable as a handle. The strip 96*a* has a cross-section that has the shape of a rectangle, but it could have the shape of a circle or of an oval. A harpoon 96*e* is formed on or near the end 96*c* opposite of the end with the handle. Harpoon 96*e* can be described, made and used essentially the same as the harpoon 92 in FIG. 28. Harpoon 96*e* has a plurality of J-shaped hooks 96*f*. The capital letter "J" in an arial font provides a very good illustration for a suitable shape for the J-shaped hooks 96*f*, although the fish-hook shape of the barbs 92*f* in FIG. 28 could be used instead.

The drain cleaning apparatus 96 of FIG. 29 is about the same as the drain cleaning apparatus 86 of FIG. 28, except for the following differences. The drain cleaning apparatus 96 of FIG. 29 is an integral unit, preferably made by plastic injection molding, including the J-shaped books 96*f*, while-the drain cleaning apparatus 86 of FIG. 28 has separate components that are assembled using connections that, generally, can be detached for disassembly of the components, which are the handle 88, the one or more extension members 90, and the harpoon 92. Strip 96*a* in FIG. 29 has a cross-section that has the shape of a rectangle, while the body 90*a* of the extension member 90 of FIG. 28 has a cross-section that has the shape of a circle or oval. The drain cleaning apparatus 96 of FIG. 29 uses J-shaped hooks 96*f*, while the drain cleaning apparatus 86 of FIG. 28 uses barbs 92*f*, which have a straight, angled projection at a distal end to provide a barb and thus have the shape of a fish hook. Otherwise, apparatus 96 is about the same as apparatus 86. Since the strip 96*a* has a cross-section that has the shape of a rectangle, strip 96*a* has a pair of broad sides and a pair of narrow sides. A plurality of J-shaped hooks are formed integral with or attached to each of the narrow sides of the strip 96*a*. End 96*c* of strip 96*a* has an outermost tip 96*g*. The J-shaped hooks 96*f* can be the same length or be of different lengths and can be arranged in a random assortment of different lengths, as can the barbs 92*f* in FIG. 28. However, the embodiment in FIG. 29 shows J-shaped hooks 96*f* having different lengths arranged with a shortest length closest to the outermost tip 96*g* with gradually longer lengths as the hooks 96*f* are spaced farther from the outermost tip 96*g*. The J-shaped hooks are oriented to present a smooth curve toward the outermost tip 96*g* and are angled away from the outermost tip 96*g*.

Harpoon 92 of FIG. 28 and harpoon 96*e* in FIG. 29 could alternatively be made as at least one arrowhead on a central shaft instead of having hooks on a central shaft. An arrowhead has a wedge shape. An arrowhead has a body with sides of about equal length that intersect at a point like an isosceles triangle. For the harpoon of the present invention, it is preferred for the base of the arrowhead opposite the point have the shape of a "V" that is upside down, making the distance between a center point of the base and the tip substantially shorter than the sides of the arrowhead. An arrowhead has a shape similar to a symbol meaning "greater than," which is the symbol ">". The shape "→" is an example of an arrowhead on a central shaft, which is provided by computer, word-processing software. One (>), two (>>), three (>>>) or four arrowheads (>>>>) arranged end-to-end (tip of one adjacent to base of another) on a central shaft would make a suitable harpoon for the present invention. This embodiment would have a shape similar to the shape illustrated in FIG. 25, except as a fixed, integral body with barbs having the shape of an arrowhead.

Figure 30:
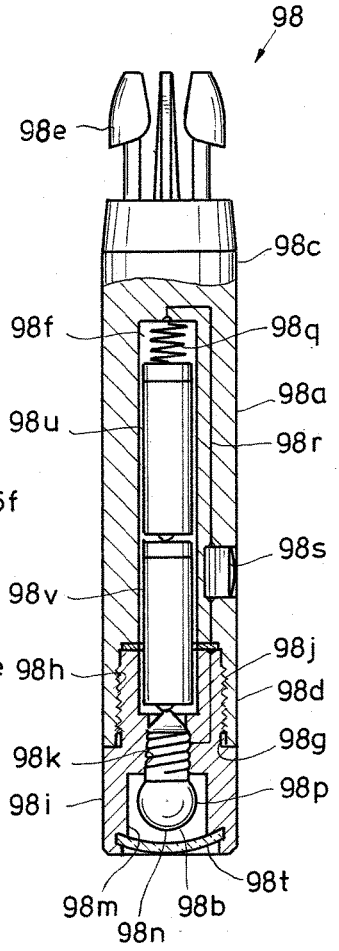
FIG. 30 is a side elevation of a flashlight, according to the present invention.

FIG. 30 is a side elevation in partial cross-section of an end tool or flashlight 98 that has an elongate body 98*a* and a light 98*b*. Body 98*a* has a connector end 98*c* and a light end 98*d*. A male, quick-connect connector 98*e* is formed integral with or attached to the connector end 98*c*. Connector 98*e* can be used to connect flashlight 98 to the handle 88 or extension member 90 of FIG. 28 or to the clog-catching member 14 of FIG. 1. A user may not wish to shine a light deep inside a small drain pipe, but the user may wish to illuminate a different, small, tight or dark space, which can be reached with flashlight tool 98 connected to extension members and/or to a handle. Body 98*a* is open on end 98*d* opposite the connector 98*e* and has a deep, cylindrical bore hole 98*f* that can receive at least one, preferably two or more, batteries, preferably of size AAA, AA, C or D. Body 98*a* has bore hole 98*g* at an outer end of end 98*d*, and a female-threaded side wall 98*h* defines bore hole 98*g*. A closure 98*i* has male threads 98*j*, which thread into engagement with the female threads in side wall 98*h* for enclosing bore holes 98*f* and 98*g*. Closure 98*i* has a central bore of two different diameters, including a smaller bore defined by a side wall 98*k* that has female threads and a larger bore defined by a side wall 98*m*. A light bulb 98*n* has a base with male threads, which is received in the female-threaded side wall 98*k* of closure 98*i*. Light bulb 98*n* has a glass bulb 98*p*, which has means for providing light. A metal spring 98*q* is fixed in the bottom of bore hole 98*f*. A conductive wire 98*r* having an on/off switch 98*s* connects spring 98*q* to the base of light bulb 98*n*. A clear window 98*t* encloses light bulb 98*n* inside the larger bore defined by defined by side wall 98*m*. Two AA batteries 98*u* and 98*v* are received end-to-end inside the deep, cylindrical bore hole 98*f*. These various components can be assembled to make the flashlight 98 operable for providing light for illuminating a space. An alternative to making the flashlight 98 is to purchase a commercially-available flashlight of a suitable size, design and material and make an elongate body having a connector on one end and a cavity on the other end, which is illustrated in FIG. 20 as end tool 74, which has cavity 74*a*. One can mold the body around an end of the flashlight or glue the end of the flashlight into the cavity in the body.

FIG. 31 is a side elevation of a brush 99 having an elongate body 99*a*, has a connector end 99*b* and a male, quick-connect connector 99*c*. The body 99*a* has a brush end 99*d* opposing the connector end 99*b*. A pair of twisted wires 99*e* and 99*f* are secured within the body 99*a* and protrude from the brush end 99*d*. Bristles 99*g* of different lengths are secured between the twisted wires 99*e* and 99*f* and project radially from the twisted wires at about a 90 degree angle with respect to the longitudinal axis of the twisted wires 99*e* and 99*f*. Bristles 99*g* protrude from the full circumference of 360 degrees of the twisted wires 99e and 99*f*. The wires 99*e* and 99*f* are formed from a single wire that loops upon itself near an outer end 99*h*, which orients the bristles 99*g* in a hemispherical shape 99*i* near the outer end 99*h*.

Regarding the advantages and benefits of the present invention, prior art tools exemplified by U.S. Pat. No. 6,775,873, issued to Luoma, for clearing clogs in sink, shower and bathtub drains are fixed in length and are generally around 18 to 21 inches long (about 45 to 55 cm). The biggest limitation of these is the fixed length, which does not always allow the device to reach the location of a clog. Also, most of these devices are single use, and irrespective of the actual length used to unclog, the complete device is generally discarded. Key benefits of the present invention include: (a) a length that is variable due to the ability to quickly connect/disconnect multiple sections; (b) since different sections are assembled together, only the section at the bottom that works on the clog is somewhat likely to be discarded, while the sections on the top are likely to be kept and reused; (c) the handle connects to the sections through a quick-release mechanism so the handle does not have to be discarded and can be reused multiple times, thereby saving money and natural resources; and (d) tools, such as a point, a harpoon, a barbed spear, a retractable spear, a helical barbed element, a magnet, a brush, a pusher/scraper and a wisk can be added to the bottom of the section to help with cleaning a drain more efficiently and effectively, and a tool such as a flashlight can serve an additional purpose.

Thus, one aspect of the present invention is the ability to add sections to extend the length of the drain cleaning device, which can allow a user to go beyond the vertical drain pipe to enter the P-trap, extension tube, and the main drain pipe to remove clogs. These sections can be added as needed. If the user is able to remove a clog by using one section to remove the clog, then that is all that is needed. If this is adequate, the disconnect allows the user to remove the used section and discard it or to clean it for reuse. If more sections are required, if the clog is deeper in the drain system, they one can simply add additional sections. Upon completion of the cleaning task, the user can disconnect each section to allow the user to either clean individual sections or discard them. This can save time, money and natural resources. There are many other advantages to this type of implementation because of the flexibility of the quick disconnect. Many types of drain cleaning tools can be attached either at the bottom or integral to the assembly, which allows the user to customize the device to a particular problem. If there is a clog at pop-up drain control rod, then use one section; clog in a P-trap—use 2 or 3 sections; clog in an extension tube—use 3 or 4 sections; clog in a main drain—add additional sections as required to reach the clog. Other attachments can be used for unusually difficult clogs. If there is a lost items that responds to magnetic attraction, then use a magnet attachment. To clean the inside of a drain pipe, use a brush attachment. Being able to easily connect and disconnect a handle from a drain cleaning apparatus is beneficial. The ability to connect and disconnect a vast variety of tools to the end of the device or within the device makes the device more flexible and cost effective than anything in the known prior art.

Additional Embodiments of the Invention

In one embodiment, the present invention provides a handheld device to remove a clog and/or hair from a sink drain, bathtub drain and/or a shower drain. The device preferably includes a quick connect/release handle and at least one quick connect/release clog catching section, which can be joined to the handle and/or to each other to make the assembly longer or shorter depending upon the location of the targeted clog. The clog catching sections may be cylindrical or flat or polygon or curved or sinusoidal. The sections can have a smooth outer surface for use as extension elements or can have barbs or prongs for catching and holding hair and other debris. The quick release connection can be of any presently known or future mechanical and/or magnetic design for coupling and connecting two elements together. Various tools can be connected to a bottommost or outermost section for various purposes including removing a clog from a drain, cleaning a drain pipe, illuminating a space with a light and retrieving objects that are subject to magnetic attraction. Examples of tools include a pointed or rounded bull nose cap on the end of a section for protruding into a clog, a harpoon for protruding into and catching onto a clog, a spear having one or more barbs for protruding into and catching onto a clog, a brush for cleaning the inside of a pipe, a magnet and a light.

In another embodiment, the present invention provides a multifunctional apparatus, preferably including a hair-clog remover. The apparatus preferably includes one or more sections of an elongate barbed device and a detachable, quick-release handle. The hair-clog remover can be inserted into a drain at a sink, bathtub, shower or toilet. Each section of the elongate barbed device may be about 6 to 18 inches long, preferably 8 to 12 inches (15 to 50 cm, preferably 20 to 30 cm). Multiple sections can be added end-to-end to reach a length of about 30 to 50 inches, preferably about 36 inches (75 to 125 cm, preferably about 90 cm). Quick-release connections or threaded connections are preferably used to detachably connect a section to a handle and to connect sections together. The sections preferably have barbs, more preferably airplane-like wings, for catching and holding hair to pull hair out of a drain pipe. The sections can also be smooth, without barbs or wings. A tool can be detachably attached to an end section, preferably by quick-release connector, for various purposes, preferably for cleaning a clog from a drain pipe. A tool can be attached that can be pushed into a clump of debris clogging a drain pipe for breaking the clog, catching and holding the clog for extraction from the drain pipe or breaking up the clog and pushing it downstream for subsequent flushing downstream. Tools that can be attached to a section include a rounded or pointed tip, such as a bull nose, a pusher/scraper, a barbed spear, a spear having retractable barbs, a harpoon having multiple barbs, a clog breaker, a brush, a wisk, a magnet and a flashlight. The apparatus offers tremendous flexibility to a consumer or end user, and natural resources are saved because the apparatus can be re-used and can be used for multiple purposes.

The present invention provides a drain cleaning harpoon in one embodiment. The harpoon includes an elongate body, which may have a cross-section that has the shape of a rectangle, a polygon, a circle or an oval. The elongate body has a proximal end and an opposing distal end. A plurality of J-shaped or fish-hook-shaped hooks are fixed to the elongate body near its distal end. The hooks are oriented to present a smooth curve toward the distal end and an inwardly curved hook toward the proximal end. The hooks preferably, but not necessarily, are longer the farther the hooks are spaced from the distal end. The drain cleaning harpoon preferably includes a handle on the proximal end of the elongate body. The drain cleaning harpoon is made as an integral unit by plastic injection molding in one embodiment and is made of separate components that can be assembled and disassembled in another embodiment.

Additional embodiments of the present invention are described as follows.

1. A device for removing a clog from a drain, comprising:
   a) a handle;
   b) a clog removal member detachably connected to the handle and including a central spine with a width or diameter, and a length;
   c) a first set of fins extending radially outwardly from the spine;
   d) a second set of fins extending radially outwardly from the spine;
   e) the first set of fins being generally trapezoid-shaped and disposed closer to the handle than the second set of fins; and
   f) the second set of fins being generally parallelogram-shaped and forming a plurality of pairs axially spaced on the spine.

2. The device of embodiment 1, wherein a plurality of the second set of fins have a length greater than the width or diameter of the central spine.

3. The device of embodiments 1 and 2, wherein the-pairs of second set of fins are generally equilaterally spaced along the entire length of the central spine.

4. The device of embodiments 1 to 3, wherein each of the pairs of second set of fins comprises generally diametrically opposed fins.

5. The device of embodiments 1 to 4, wherein the first set of fins comprises two generally diametrically opposed fins.

6. The device of embodiments 1 to 5, wherein each of the first set of fins includes an outermost edge for guiding the device along the inner surface of the drain.

7. The device of embodiments 1 to 5, wherein the second set of fins comprises five to twenty pairs of generally diametrically opposed fins.

8. The device of embodiments 1 to 7, wherein the clog removal member is connected to the handle by a side release locking mechanism.

9. The device of embodiments 1 to 8, further comprising an accessory device for cleaning the inside of the drain.

10. The device of embodiment 9, wherein the accessory device is detachably connected to the clog removal member by a side release locking mechanism.

11. The device of embodiments 9 to 10, wherein the accessory device comprises a brush.

12. The device of embodiments 9 to 10, wherein the accessory device comprises a magnetic member for removing a magnetically attractive metallic object from the drain.

13. The device of embodiments 9 to 10, wherein the accessory device comprises a corkscrew.

14. The device of embodiments 9 to 13, wherein the device comprises a plurality of the accessory devices.

15. The device a embodiments 9 to 13, wherein the device comprises a plurality of the clog removal members and a plurality of the accessory devices.

16. The device of embodiments 1 to 8, wherein the device comprises a plurality of the clog removal members.

17. The device of embodiments 1 to 16, wherein the length of the clog removal member is from about 6 to 24 inches (15 to 60 cm), preferably 8 to 16 inches (20 to 40 cm) and more preferably from about 9 to 14 inches (22 to 36 cm) and may be about 10 to 12 inches (25 to 30 cm).

18. The device of embodiments 1 to 17, wherein the clog removal member includes a generally conically shaped end member for boring through the clog.

19. The device of embodiments 1 to 17 or of embodiment 18, wherein the end member includes a plurality of barbs.

20. The device of embodiment 19, wherein the barbs extend radially outwardly and have progressively shorter lengths toward the tip of the end member.

21. A device for removing a clog from a drain, comprising:
   a) a handle;
   b) a clog removal member detachably connected to the handle and including a central spine with a width or diameter, and a length;
   c) a first set of guide fins extending radially outwardly from the spine for smooth insertion into and removal of the device from the drain;
   d) a second set of generally parallelogram-shaped fins extending radially outwardly from the spine for trapping the clog;
   e) the second set of fins forming a plurality of pairs generally equilaterally spaced along the entire length of the central spine; and
   f) a plurality of the second set of fins having a length greater than the width or diameter of the central spine.

22. The device of embodiment 21, wherein the first set of guide fins are generally trapezoid-shaped and disposed closer to the handle than the second set of fins.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain cleaning apparatus, comprising:

a handle having opposing ends and a gripping portion, wherein one of the ends comprises a handle connector; and a clog-catching member having a body that has a length, a proximal end and a distal end, wherein the proximal end has a proximal-end connector that is detachably connected to the handle connector, wherein the distal end has a distal-end connector that has the same structure as the handle connector, and wherein a plurality of wings, barbs or hooks project radially from the body with respect to the longitudinal axis of the body, wherein the handle, the clog-catching member, and the plurality of wings, barbs or hooks have a combination of strength, stiffness, flexibility and length to enable a user to push the clog-catching member through a drain opening in a sink and into a drain pipe.

2. The drain cleaning apparatus of claim 1, further comprising a tool having a mechanical device and a member connector that is detachably connected to the distal-end connector of the clog-catching member, wherein the member connector has the same structure as the proximal-end connector on the clog-catching member.

3. The drain cleaning apparatus of claim 2, wherein the proximal-end connector that is detachably connected to the handle connector and the member connector that is detachably connected to the distal-end connector of the clog-catching member comprises a quick-release coupling mechanism, a push-button mechanism, a side-release buckle mechanism or a threaded-connection mechanism.

4. The drain cleaning apparatus of claim 3, wherein the mechanical device of the tool is selected from the group consisting of a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, a whisk, and a hook.

5. The drain cleaning apparatus of claim 1, wherein the handle has the shape of the capital letter "T".

6. The drain cleaning apparatus of claim 1, wherein the clog-catching member is a first clog-catching member, further comprising a second clog-catching member that has a structure that is the same as the structure of the first clog-catching member, wherein the second clog-catching member is connected to the distal end of the first clog-catching member.

7. The drain cleaning apparatus of claim 6, further comprising a third clog-catching member that has a structure that is the same as the structure of the first and second clog-catching members, wherein the third clog-catching member is connected to the second clog-catching member.

8. The drain cleaning apparatus of claim 7, further comprising a tool connected to the third clog-catching member.

9. The drain cleaning apparatus of claim 1, further comprising a guide element that projects from the body of the clog-catching member for guiding the clog-catching member through the drain pipe as the clog-catching member is retracted from the drain pipe.

10. The drain cleaning apparatus of claim 9, wherein the guide element comprises a pair of opposing guide wings that have guide edges, wherein lines lying on the guide edge of each guide wing intersect to form a "V" shape that points toward the proximal end of the clog-catching member.

11. The drain cleaning apparatus of claim 10, wherein the body of the clog-catching member has a cross-section that is circular or oval in shape.

12. The drain cleaning apparatus of claim 10, wherein a magnet is embedded in the body of the clog-catching member near or in its distal end.

13. The drain cleaning apparatus of claim 1, wherein the clog-catching member has a length between 6 and 24 inches (or 15 to 61 cm).

14. The drain cleaning apparatus of claim 13, wherein the body of the clog-catching member has a diameter of between 0.1 and 0.5 inches (or 0.25 to 1.27 cm).

15. The drain cleaning apparatus of claim 1, wherein the gripping portion of the handle provides a means for a person to hold the handle for manual use of the drain cleaning apparatus.

16. A kit, comprising:

a disassembled drain-cleaning apparatus, comprising:

a handle having a connector A;

at least one clog-snagging member, wherein the member comprises a body that has a length and opposing ends with a connector B on one end and a connector C on the other end, wherein the connector B can be removably connected to the connector A, wherein the body has a first plurality of wing-like projections spaced apart along the length of the body and a second plurality of wing-like projections spaced apart along the length of the body, wherein the first and second plurality of wing-like projections are separated from one another by about 180 degrees plus or minus about 15 degrees; and at least one tool having a size and shape suitable for insertion into a drain pipe from a sink, bathtub or a toilet for unclogging the drain pipe or cleaning the inside of the drain pipe or retrieving an object from inside the drain pipe, wherein the tool has a connector D, wherein the connector D can be removably connected to the connector C, and wherein an assembled drain-cleaning apparatus can be made by connecting the connector B to the connector A and connecting the connector D to the connector C.

17. The kit of claim 16, wherein the connectors A, B, C and D are quick-connect connectors or threaded connectors, wherein the connector C has the same structure as the connector A, and wherein the connector D has the same structure as the connector B.

18. The kit of claim 17, wherein the tool is selected from the group consisting of a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, a whisk, and a hook.

19. A drain cleaning apparatus, comprising:

a handle having a handle connector;

an extension member having a proximal end that has an extension-handle connector and a distal end that has a distal-end connector, wherein the extension-handle connector is detachably connected to the handle connector;

an elongate body having a proximal end and a distal end; and a plurality of J-shaped or fish-hook-shaped hooks fixed to, embedded in or formed integral with the body near the distal end of the body, wherein the elongate body has the size, strength, stiffness, flexibility and length to enable a user to push the elongate body and the hooks through a drain opening in a sink and into a drain pipe, and wherein the elongate body has a body-extension connector on its proximal end that is detachably connected to the distal-end connector on the extension member.

20. The drain cleaning apparatus of claim 19, wherein the distal-end connector on the extension member has the same structure as the handle connector.

21. The drain cleaning apparatus of claim 20, wherein the extension member has guide fins that project radially with respect to the longitudinal axis of the extension member.

22. A drain cleaning apparatus, comprising:

a handle having a gripping portion for a person to hold for manual operation, wherein the handle has a first quick-connect connector;

an extension member having a body that has a length and opposing ends, a second quick-connect connector on one end and a third quick-connector on the other end, wherein the extension member is a smooth rod that does not have wings, barbs or hooks for catching hair or cleaning debris, and wherein the extension member has guide fins for centering the extension member in a drain pipe; and a tool for unclogging a drain pipe or for retrieving an item out of a drain pipe or for cleaning the inside of a drain pipe or for shining a light into a space, wherein the tool has a fourth quick-connect connector, wherein the second quick-connect connector can be connected to and disconnected from the first quick-connect connector, wherein the fourth quick-connect connector can be connected to and disconnected from the third quick-connect connector, wherein the first and third quick-connect connectors have the same structure, and wherein the second and fourth quick-connect connectors have the same structure.

23. The drain cleaning apparatus of claim 22, wherein the tool is selected from the group consisting of a clog-catching member, a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, whisk, and a hook.

24. A kit comprising a disassembled drain-cleaning apparatus, the kit comprising:

a handle having a connector A and a gripping portion for a person to hold for manual operation;

a first clog-catching member, wherein the first clog-catching member comprises a body that has a length and opposing ends with a connector B on one end and a connector C on the other end, and wherein the connector B can be removably connected to the connector A; and a second clog-catching member having a size and shape suitable for insertion into a drain pipe from a sink, bathtub or a toilet for unclogging the drain pipe wherein the second clog-catching member has a connector D on one end and a connector E on the other end, wherein the connector D can be removably connected to the connector C, wherein an assembled drain-cleaning apparatus can be made by connecting the connector B to the connector A and connecting the connector D to the connector C, and wherein the first and second clog-catching members each have a plurality of wings, barbs or hooks, wherein the connectors A, C and E have the same structure, and wherein the connectors B and D have the same structure.

25. The kit of claim 24, further comprising a tool having a connector F, wherein the connector F can be detachably connected to the connector E, and wherein the tool is selected from the group consisting of a clog-catching member, a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, a whisk, and a hook.

26. A drain cleaning apparatus, comprising:

a handle having opposing ends and a gripping portion, wherein one of the ends comprises a handle connector;

a clog-catching member having a body that has a length, a proximal end and a distal end, wherein the proximal end has a proximal-end connector that is detachably connected to the handle connector, and wherein a plurality of wings project radially from the body with respect to the longitudinal axis of the body, wherein the distal end of the clog-catching member has a tool connector; and a tool having a mechanical device and a member connector that is detachably connected to the tool connector, wherein the handle, the clog-catching member, and the plurality of wings have a combination of strength, stiffness, flexibility and length to enable a user to push the clog-catching member through a drain opening in a sink and into a drain pipe.

27. The drain cleaning apparatus of claim 26, wherein the proximal-end connector that is detachably connected to the handle connector and/or the member connector that is detachably connected to the distal-end connector of the clog-catching member comprises a quick-release coupling mechanism, a push-button mechanism, a side-release buckle mechanism or a threaded-connection mechanism.

28. The drain cleaning apparatus of claim 27, wherein the mechanical device of the tool is selected from the group consisting of a pointed element, a rounded element, a hemispherical element, a barbed element, a barbed spear, a spear with a plurality of barbs, a spear comprising a plurality of arrowheads, a retractable spear with a plurality of barbs, a helical spear with a plurality of barbs, a helical spear that can rotate and has a plurality of barbs, a harpoon, a harpoon that has a plurality of fish hooks or J-hooks, a pusher/scraper, a brush, a magnet, a light, a corkscrew, a coiled spring, an element with an adhesive, a whisk, and a hook.

29. A drain cleaning apparatus, comprising:

a handle;

an elongate body having a proximal end and a distal end;

a plurality of J-shaped or fish-hook-shaped hooks fixed to, embedded in or formed integral with the body near the distal end of the body, wherein the elongate body has the size, strength, stiffness, flexibility and length to enable a user to push the elongate body and the hooks through a drain opening in a sink and into a drain pipe; and an extension member between the elongate body and the handle, wherein the extension member is removably connected to the handle, and wherein the elongate body is removably connected to the extension member so that the handle, the extension member and the elongate body can be assembled to form the drain cleaning apparatus and can be subsequently disassembled.

* * * * *